US012031221B1

(12) United States Patent
Wakerley et al.

(10) Patent No.: US 12,031,221 B1
(45) Date of Patent: Jul. 9, 2024

(54) SEPARATORS FOR LIQUID PRODUCTS IN OXOCARBON ELECTROLYZERS

(71) Applicant: Dioxycle, Bordeaux (FR)

(72) Inventors: David Wakerley, Paris (FR); Sarah Lamaison, Paris (FR); Ruperto G Mariano, South San Francisco, CA (US)

(73) Assignee: Dioxycle, Bordeaux (FR)

( * ) Notice: Subject to any disclaimer, the term of this patent is extended or adjusted under 35 U.S.C. 154(b) by 0 days.

(21) Appl. No.: 18/369,838

(22) Filed: Sep. 18, 2023

Related U.S. Application Data

(60) Provisional application No. 63/438,519, filed on Jan. 11, 2023.

(51) Int. Cl.
*B01D 61/02* (2006.01)
*B01D 61/42* (2006.01)
(Continued)

(52) U.S. Cl.
CPC ..... *C25B 3/25* (2021.01); *C25B 1/02* (2013.01); *C25B 15/031* (2021.01);
(Continued)

(58) Field of Classification Search
CPC .... C25B 3/25; C25B 3/26; C25B 1/02; C25B 1/16; C25B 3/23; C25B 15/08;
(Continued)

(56) References Cited

U.S. PATENT DOCUMENTS 2,829,095 A 4/1958 Oda et al.
2,967,806 A * 1/1961 Osborne ..... C25B 3/00 204/266
(Continued)

FOREIGN PATENT DOCUMENTS

EP 3470389 A1 * 4/2019 ..... C07C 51/02
EP 3473750 A1 4/2019
(Continued)

OTHER PUBLICATIONS

Du et al., "An Electro-Oxidation Reactor for Treatment of Nanofiltration Concentrate Towards Zero Liquid Discharge," Science of the Total Environment (Aug. 20, 2021), vol. 783, pp. 1-10. (Year: 2021).*
(Continued)

*Primary Examiner* — Edna Wong
(74) *Attorney, Agent, or Firm* — Daylight Law, P.C.

(57) ABSTRACT

Methods and systems which involve separating liquid products are disclosed herein. A disclosed method includes supplying a volume of oxocarbon carbon to a cathode area of an oxocarbon electrolyzer to be used as a reduction substrate, generating a volume of an organic anion using the reduction substrate, and obtaining a liquid stream from the oxocarbon electrolyzer which includes the volume of the organic anion and a volume of a base. The method also includes generating, using a separation process and from the liquid stream, a first stream and a second separate stream. The separation process separates a volume of cations from the liquid stream. The first stream includes a second volume of the base. The second stream includes a volume of organic acid. The volume of organic acid includes the volume of organic anions. The second volume of the base includes the volume of cations.

17 Claims, 16 Drawing Sheets

(51) Int. Cl.

| | |
|---|---|
| ***B01D 61/44*** | (2006.01) |
| ***C25B 1/02*** | (2006.01) |
| ***C25B 3/25*** | (2021.01) |
| ***C25B 15/031*** | (2021.01) |
| ***C25B 15/08*** | (2006.01) |

(52) U.S. Cl.
CPC ..... *C25B 15/081* (2021.01); *C25B 15/083* (2021.01); *C25B 15/087* (2021.01)

(58) Field of Classification Search
CPC ... C25B 15/083; C25B 15/087; B01D 61/422; B01D 61/027; B01D 61/44
USPC ..... 205/440, 478, 480, 508, 512, 510, 518; 204/518, 520, 539, 541, 544; 210/748.01
See application file for complete search history.

(56) References Cited

U.S. PATENT DOCUMENTS

| | | | | |
|---|---|---|---|---|
| 4,897,167 | A | 1/1990 | Cook et al. | |
| 6,221,225 | B1 | 4/2001 | Mani | |
| 8,845,877 | B2 | 9/2014 | Cole et al. | |
| 8,845,878 | B2 | 9/2014 | Cole et al. | |
| 9,090,976 | B2 | 7/2015 | Bocarsly et al. | |
| 11,131,028 | B2 | 9/2021 | Kaczur et al. | |
| 11,479,871 | B2 | 10/2022 | Kanan et al. | |
| 2008/0223727 | A1 | 9/2008 | Oloman et al. | |
| 2013/0180863 | A1 | 7/2013 | Kaczur et al. | |
| 2014/0206895 | A1 | 7/2014 | Twardowski et al. | |
| 2016/0221906 | A1 * | 8/2016 | Kim | B01J 35/006 |
| 2021/0047743 | A1 | 2/2021 | Goetheer et al. | |

FOREIGN PATENT DOCUMENTS

| | | | | | |
|---|---|---|---|---|---|
| KR | 20170117933 | A | * | 10/2017 | B01D 61/445 |
| WO | 2013134418 | A1 | | 9/2013 | |
| WO | WO-2014042781 | A2 | * | 3/2014 | C25B 1/04 |
| WO | 2015195149 | A1 | | 12/2015 | |
| WO | 2022040784 | A1 | | 3/2022 | |
| WO | 2022235708 | A1 | | 11/2022 | |
| WO | WO-2023194360 | A1 | * | 10/2023 | C07B 59/001 |

OTHER PUBLICATIONS

Wang et al., "Chemicals-Free Approach Control Interface Characteristics of Nanofiltration Membrane: Feasibility and Mechanism Insight into CEM Electrolysis," Water Research (Nov. 1, 2021), vol. 206, pp. 1-10. (Year: 2021).*

D. Yang et al. 2020. Electroreduction of CO2 in Ionic Liquid-Based Electrolytes. Innovation (Cambridge (Mass.)), 1(1), 100016. https://doi.org/10.1016/j.xinn.2020.100016.

S. Overa et al. 2022. Enhancing acetate selectivity by coupling anodic oxidation to carbon monoxide electroreduction. Nat Catal 5, 738-745. https://doi.org/10.1038/s41929-022-00828-w.

S. Park et al. 2021. Towards the Large-Scale Electrochemical Reduction of Carbon Dioxide. Catalysts 11, No. 2: 253. https://doi.org/10.3390/catal11020253.

Non-Final Office Action dated Apr. 29, 2024 from U.S. Appl. No. 18/408,873, 39 pages.

D.S. Ripatti, et al. (2019). Carbon Monoxide Gas Diffusion Electrolysis that Produces Concentrated C2 Products with High Single-Pass Conversion. Joule.

International Search Report and Written Opinion from International Application No. PCT/IB2024/050297 dated Apr. 22, 2024, 22 pages.

* cited by examiner

700

SEPARATORS FOR LIQUID PRODUCTS IN OXOCARBON ELECTROLYZERS

CROSS REFERENCE TO RELATED APPLICATIONS

This application claims the benefit of U.S. Provisional Application No. 63/438,519, filed on Jan. 11, 2023, which is incorporated by reference herein in its entirety for all purposes.

BACKGROUND

There is an urgent need to develop technologies which make the capture or valorization of oxocarbons more economical in highly emitting sectors of the economy. Furthermore, there is an urgent need to reduce emissions related to the production of useful fuels and chemicals in our society and to find alternative ways to produce such fuels sustainably instead of relying on fossil resource extraction and processing for their production. Accordingly, technologies that both generate useful fuels and chemicals, while at the same time using oxocarbon feedstocks that would otherwise have been emitted into the atmosphere, are critically important because they both generate useful chemicals without additional emissions and because the economic value of the useful chemicals can offset the cost of the oxocarbon capture and conversion.

There are at present several economically beneficial methods for the conversion of oxocarbons such as carbon monoxide and carbon dioxide into more valuable species. These include processes such as the hydrogenation of carbon dioxide, solid oxide electrolysis, or low temperature oxocarbon electrolysis. These technologies often produce liquid products, such as organic acids, alcohols, or other hydrocarbons, which have high commercial value once they are purified from the outlet stream.

SUMMARY

Methods and systems which involve separating liquid products are disclosed herein. The liquid products can be generated during the valorization of oxocarbons. The liquid products can be generated or consumed during the operation of an electrolysis device. The liquid products can be generated or consumed during the operation of an oxocarbon electrolyzer. The liquid products can be generated during the valorization of an oxocarbon in an oxocarbon electrolyzer and separated in order to produce a concentrated stream of valuable chemicals for commercialization. Alternatively, or in combination, the liquid products can be in a fluid electrolyte of an electrolyzer and can be removed from the electrolyte in order to refresh the electrolyte and the concomitant efficiency of the electrolyzer. The liquid products can include an organic species or an alcohol in a basic fluid. The liquid products can be separated from a base which serves as the electrolyte of the electrolysis device.

As used herein, valorization of oxocarbons refers to the transformation of the carbon and oxygen components of the oxocarbon into useful species of more economically valuable chemicals such as hydrocarbons, organic acids, alcohols, olefins, and N-rich organic compounds. These useful species can be generated in an oxocarbon electrolyzer and separated out using the approaches disclosed herein. Using the approaches disclosed herein, such chemicals can be generated and isolated for use cost-competitively with conventional petrochemical routes and contribute to the development of a carbon circular economy.

One problem with oxocarbon electrolyzers, and some other electrolysis devices, is that they use basic fluid streams in the reactor. For example, the electrolysis of carbon monoxide generally uses basic fluid streams in the reactor to ensure effective conversion. Basic fluid streams are problematic because they can be difficult to separate from ionically charged or miscible species, such as, but not limited to, organic species such as ethanol, acetate, propanol, and propionic acid. This is problematic because such chemicals are some of the valuable chemicals mentioned above that could offset the cost of running the electrolyzer and otherwise capturing and processing the oxocarbons. Separation of such species may require large additional energy requirements to neutralize and/or evaporate them from the output stream of the oxocarbon valorizing technology. These separation requirements add cost to the conversion process and may render the process commercially infeasible from an energetic perspective. For this reason, cost-effective means to separate valuable organic species from an aqueous basic stream will improve the economic viability of environmentally beneficial emission-valorizing systems.

In specific embodiments of the inventions disclosed herein, liquid products are separated in an oxocarbon electrolyzer. The liquid products can be separated from liquid streams or gaseous streams. The liquid products can be referred to as liquid products because they are themselves liquid or because they are solutes in an aqueous solution. The liquid products can be useful species generated during the operation of the oxocarbon electrolyzer. Alternatively, or in combination, the liquid products can be species which degrade the performance of an oxocarbon electrolyzer as they build up in the electrolyte of the oxocarbon electrolyzer. The liquid products can be negatively charged ionic species (i.e., anions) and the liquid products can be separated from a basic stream. The liquid products can be organic anions. The liquid products can include carboxylate or carboxylic acid. Basic streams can be referred to herein as basic streams because they include a base and are meant to be basic in a functioning system. As such, those of ordinary skill will understand that as a byproduct builds up to an unacceptable degree in the basic streams disclosed herein, the stream may be less basic. The liquid products discussed herein can be organic species and the liquid products can be separated from a basic stream. The basic streams disclosed herein could be the electrolyte of an electrolyzer. The liquid products can be acidic, such as acetic acid or propionic acid, and the basic stream can be the electrolyte of an oxocarbon electrolyzer. The liquid products could be in a liquid because they were generated intentionally in the liquid products as part of the process of generating a useful species from the oxocarbon, or because they are generated as a byproduct of the process of generating a useful species from the oxocarbon. The liquid products can be taken from an anode area of the electrolyzer, a cathode area of the electrolyzer, or a separating area of the electrolyzer located between the cathode area and anode area if one is present.

In specific embodiments of the inventions disclosed herein, a liquid electrolyte of an oxocarbon electrolyzer is circulated in the oxocarbon electrolyzer for various uses and in various ways. The liquid electrolyte could be circulated from the anode area, from the cathode area, or from a separating area if one is present. In specific embodiments, the liquid electrolyte is circulated by being passed through a separator before being fed back into the electrolyzer. In specific embodiments of the invention, the separator separates out negatively charged ionic species from a liquid stream. In specific embodiments, the separator separates out one or more acidic species, such as a carboxylic acid (e.g., acetic acid or propionic acid) from a basic liquid stream. In specific embodiments, a concentrated stream of base is separated from the acidic species and is used to refresh an electrolyte of the electrolyzer and to maintain a required pH of operation for the electrolyzer above a desired level. In specific embodiments, the liquid electrolyte is circulated from one, two, or three of the aforementioned areas and is circulated by being passed through a common separator, or individual separators for each area, before being fed back to one, two, or three of the aforementioned areas.

In specific embodiments, the liquid electrolyte is circulated from the areas mentioned above and is stored in one or more tanks, or sent to one of multiple separators, prior to being circulated. Storing the electrolyte in the one or more tanks, or sending it to one of multiple separators, allows for liquid products to be separated from the electrolyte using a separating technology that generates purified electrolyte more slowly than the electrolyzer degrades purified electrolyte. In such a system, a chemical generated during the electrolysis can be separated using a separate system operating on one or more of the tanks while another tank of the one or more tanks is used to continue to supply purified electrolyte to the electrolyzer.

In specific embodiments of the inventions disclosed herein, various separating technologies are provided for separating liquid products from a liquid stream. Specific embodiments disclosed herein can separate negatively charged ionic species from a basic stream without acidifying the entire liquid stream, including the base, and thereby operate using lower energy requirements than alternative approaches. The separating technologies include separators that operate using the principle of electrodialysis. The separating technologies include separators operating using the principle of selective binding. The separating technologies include separators using nanofiltration. The separating technologies include separators using Kolbe electrolysis on carboxylate. The separating technologies include separators that pyrolyze carboxylate.

In specific embodiments of the inventions disclosed herein, in which the separating technology is used to separate liquid products for an oxocarbon electrolyzer, and the separating technology includes a separator in the form of an electrodialysis electrolyzer operating using the principle of electrodialysis, dihydrogen generated at the cathode of the electrodialysis electrolyzer can be circulated from the cathode to the anode to reduce the energy requirements of the separator.

BRIEF DESCRIPTION OF THE DRAWINGS

The accompanying drawings illustrate various embodiments of systems, methods, and other aspects of the disclosure. A person with ordinary skills in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another and vice versa. Furthermore, elements may not be drawn to scale. Non-limiting and non-exhaustive descriptions are described with reference to the following drawings. The components in the figures are not necessarily to scale, emphasis instead being placed upon illustrating principles.

FIG. 3 also illustrates a flow chart for a set of method steps for the separation process with electrodialysis separator using cation exchange membranes in accordance with specific embodiments of the inventions disclosed herein.

FIG. 5 also illustrates a flow chart for a set of methods with an electrodialysis separator using anion exchange membranes in accordance with specific embodiments of the inventions disclosed herein.

FIG. 6 also illustrates a flow chart for a set of method steps with the electrodialysis separator using anion exchange membranes integrated with a CO electrolyzer in accordance with specific embodiments of the inventions disclosed herein.

DETAILED DESCRIPTION

Figure 1:
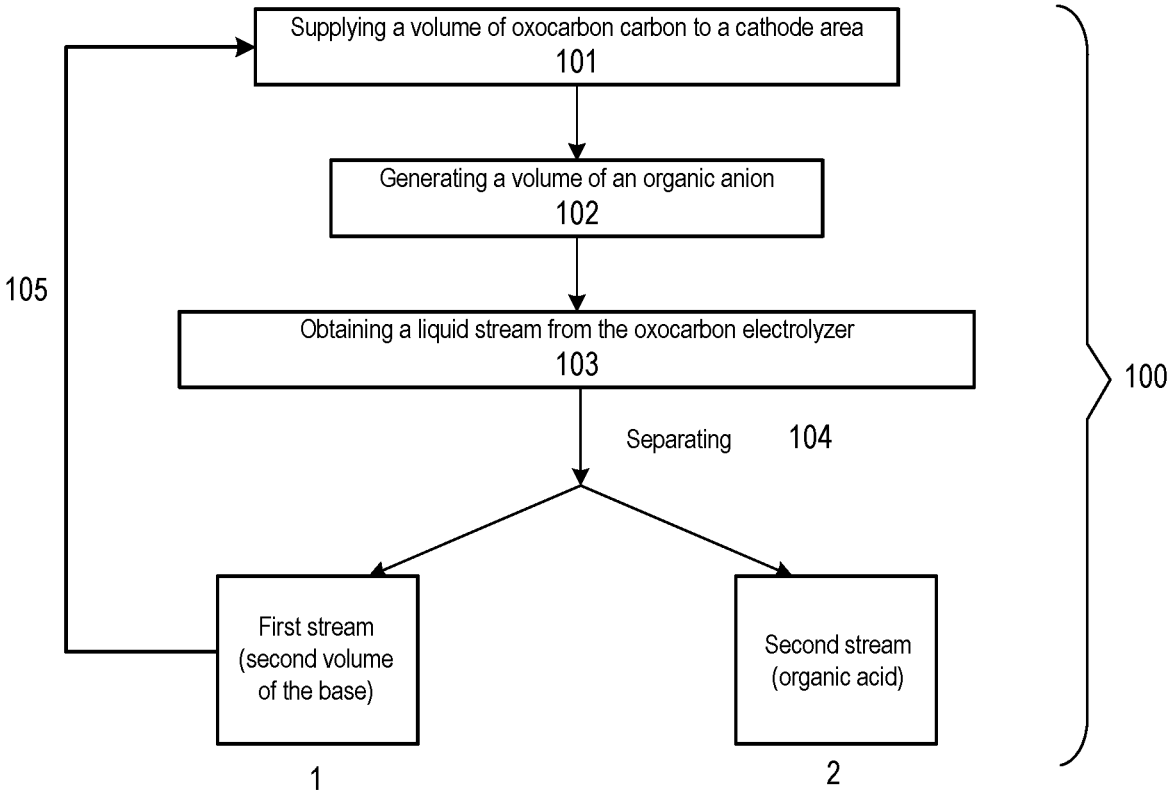
FIG. 1 illustrates a flow chart for a set of methods in accordance with specific embodiments of the inventions disclosed herein.

Reference will now be made in detail to implementations and embodiments of various aspects and variations of systems and methods described herein. Although several exemplary variations of the systems and methods are described herein, other variations of the systems and methods may include aspects of the systems and methods described herein combined in any suitable manner having combinations of all or some of the aspects described.

Methods and systems which involve separating liquid products are disclosed in detail herein. The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

In specific embodiments of the inventions disclosed herein, a separator extracts purified streams of liquid products, such as carboxylic acid (e.g., acetic acid and propionic acid), from a basic aqueous stream. The basic aqueous stream may be taken from the output of an oxocarbon electrolyzer. As such, in specific embodiments, the separator may also regenerate a concentrated stream of base that may be added to the anolyte of the oxocarbon electrolyzer in order to maintain the required pH of operation of the oxocarbon electrolyzer. Specific embodiments of the invention will be described with reference to oxocarbon electrolyzers, and more specifically with reference to carbon monoxide electrolyzers, as an example of a potential application of the separators disclosed herein. However, those of ordinary skill will recognize that the approaches disclosed herein are more broadly applicable to other oxocarbon electrolyzers, to electrolysis devices generally, and to liquid product separation more broadly.

Separating species from the electrolyte of a CO electrolyzer that lowers the pH of the electrolyte and replenishing the hydroxide content of the CO electrolyzer are important goals for improving the performance of a CO electrolyzer. With specific reference to CO electrolysis for the production of useful chemicals, the cathodic electrosynthesis of acetate in alkaline media leads to the stoichiometric consumption of one equivalent of hydroxide electrolyte for every equivalent of carboxylate produced because of charge balance. Additional carboxylate is produced when alcohols such as ethanol and propanol are oxidized to acetate and propionate at the anode, leading to further consumption of hydroxide. Further losses in the hydroxide content of the system anolyte arise from the transport, generation, and/or dialysis of hydroxide to or at the cathode and into the cathode trap, where it is physically segregated from the anolyte. The consumption of hydroxide and/or its inefficient transport to the anode during CO electrolysis leads to a lower electrolyte pH at steady-state relative to initial conditions, which leads to declines in performance because the energy efficiency of earth-abundant anodes for CO electrolysis generally perform best in strongly alkaline media. Lower electrolyte pH also leads to the dissolution of labile species necessary for high performance from the anode, (e.g., Fe), possibly followed by their redeposition on the cathode, leading to increase in cell voltage and loss in selectivity for valuable products at the cathode. The consumption of hydroxide also increases cell voltage and energy consumption by lowering solution conductivity, because the specific molar conductivity of carboxylate is lower than that of hydroxide. CO electrolysis systems have only recently reached high productivities such that large amounts of hydroxide are converted during electrolysis, leading to instances where hydroxide consumption becomes a large contributor to decline in performance and loss of electrolyzer lifetime.

Separating amphiphilic species from the electrolyte of an electrolyzer is also an important goal for improving the performance of an electrolyzer. Alkali metal carboxylates and carboxylic acids are amphiphilic substances that also lower the pH of the electrolyte by consuming hydroxide such that there are dual benefits to removing such chemicals from the electrolyte. When the aforementioned chemicals are generated during CO electrolysis and build up in the CO electrolyzer, these substances degrade the hydrophobicity of the cathode and thus impede the efficient transport and conversion of CO. It is thus of interest to actively remove these species from the reaction medium to preserve the rate of CO transport and conversion. Under some conditions, alkali metal carboxylates can also precipitate as solids, leading to impeded gas, ionic, and electronic transport through the electrolyzer and thus reducing overall efficiency.

FIG. 1 illustrates a flow chart 100 for a set of methods. The methods include a step 101 of supplying a volume of oxocarbon to a cathode area of an oxocarbon electrolyzer to be used as a reduction substrate. The methods also include a step 102 of generating a volume of an organic anion using the reduction substrate. For example, the organic anion could be carboxylate. The method also includes a step 103 of obtaining a liquid stream from the oxocarbon electrolyzer. The liquid stream could include the volume of the organic anion and a volume of a base. The base could be a metal hydroxide such as potassium hydroxide. The liquid stream could be obtained directly from a chamber of the electrolyzer (i.e., the liquid stream could be a liquid electrolyte of the electrolyzer) or it could be obtained from a gaseous phase area of the electrolyzer using a liquid trap on an output of the gaseous phase area. The method also includes a step 104 of generating, using a separation process and from the liquid stream, a first stream and a second stream. The first stream and the second stream are separate. The separation process separates a volume of a cation from the liquid stream. The cation could be an ionic form of a metal (M) such as potassium, sodium, cesium, or lithium. The first stream includes a second volume of the base. The second stream includes a volume of an organic acid. The organic acid could be carboxylic acid. The volume of the organic acid includes the volume of the organic anion. The second volume of the base can include the volume of the cation.

In specific embodiments, the first stream and the second stream can be formed in different ways depending upon the separator process that is employed. For example, the first stream and the second stream could be generated simultaneously by a separator process that operates on an input stream where the separator includes two outputs such as the electrodialysis reactors described below. As another example, the first stream and the second stream could be generated at different times by a separator process that operates on an input stream where the separator includes a single output that provides the first stream at a first time during one phase of operation of the separator and that provides the second stream at a second time during a different phase of operation of the separator.

In specific embodiments of the invention, the first stream can be recirculated back to the CO electrolyzer 105 such that the pH of the CO electrolyzer can remain sufficiently high. In specific embodiments of the invention, in the alternative or in combination, the second stream can be a stream of byproducts that are removed from the electrolyte of the electrolyzer such that the pH of the CO electrolyzer can remain sufficiently high, or the second stream can be used as a purified source of valuable chemicals that can contribute to the economic operation of the CO electrolyzer. For example, the CO electrolyzer can be designed to produce ethylene, and acetate can be produced as a byproduct that needs to be removed to maintain the pH of the electrolyte. Alternatively, the CO electrolyzer can be designed to produce acetate which is converted to acetic acid to offset the cost of operating the electrolyzer.

Figure 2:
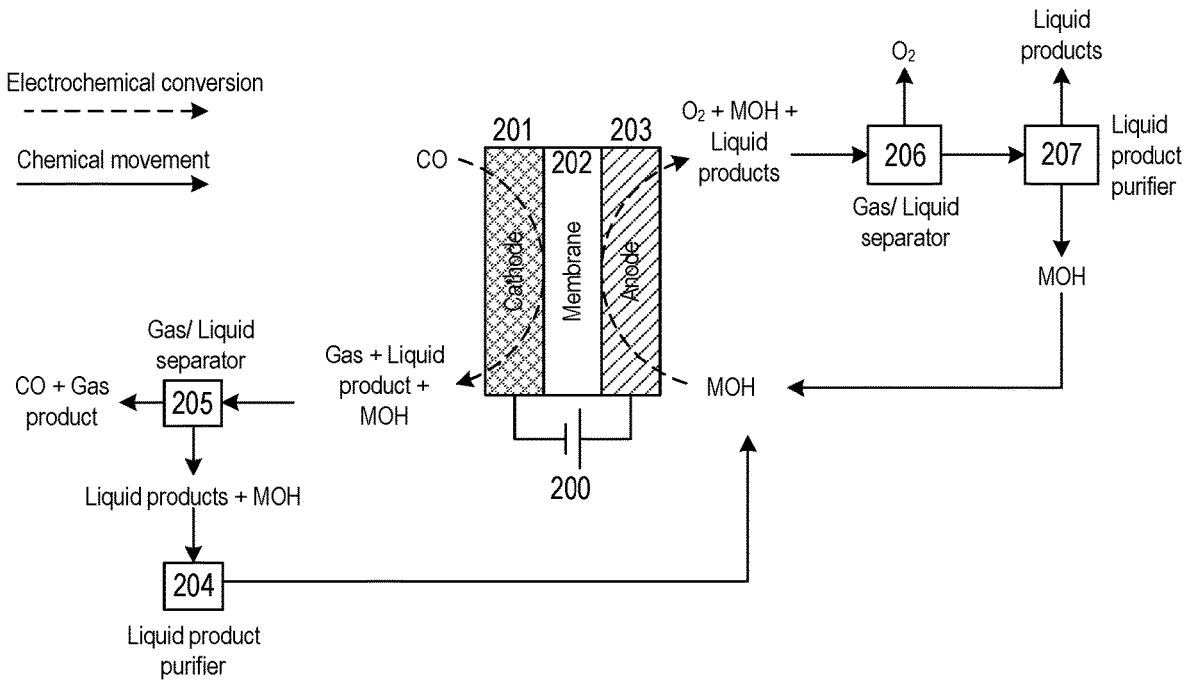
FIG. 2 illustrates a system that can be used to execute specific methods from the set of methods of FIG. 1.

FIG. 2 illustrates a system that is capable of executing methods that are in accordance with some of the methods disclosed with reference to FIG. 1. In FIG. 2, a CO electrolyzer 200 is composed of a cathode area 201 comprising a gas-diffusion layer and a CO-reduction catalyst. The anode catalyst comprises at least one of iridium and ruthenium supported onto a porous titanium-based support of any shape (such as but not limited to a foam, a mesh, a conductive porous transport layer, PTL). The anode catalyst could alternatively comprise at least one of nickel, gold, iron, steel, cobalt, manganese, titanium, boron doped diamond. In this case, CO reduction is carried out by the cathode catalyst and the resulting products include one or more of the following: acetate ($CH_3COO^-$), ethanol ($C_2H_5OH$), ethylene ($C_2H_4$), propionate ($C_2HsCOO^-$), propanol ($C_3H_8O$), propylene ($C_3H_6$), produced according to the CO-reduction reactions 1-6:

$$2CO+3H_2O+4e^-\rightarrow CH_3COO^-+3OH^- \quad (1)$$

$$2CO+7H_2O+8e^-\rightarrow C_2H_5OH+8OH^- \quad (2)$$

$$2CO+6H_2O+8e^-\rightarrow C_2H_4+8OH'' \quad (3)$$

$$3CO+6H_2O+8e^-\rightarrow CH_3CH_2COO^-+7OH \quad (4)$$

$$3CO+10H_2O+12e^-\rightarrow CH_3CH_2CH_2OH+12OH^- \quad (5)$$

$$3CO+9H_2O+12e^-\rightarrow CH_2CHCH_3+12O^-H \quad (6)$$

FIG. 2 provides an example of a CO electrolyzer that generates high-added-value products. Coupled liquid product purifiers 204 and 207 are used to separate the high-value liquid products from a basic stream containing MOH. The electrolyzer is installed in a system as depicted in FIG. 2 with MOH as an electrolyte. The aqueous MOH is fed to the anode area 203 which is produces $O_2$ through hydroxide oxidation reaction 7:

$$4OH^-\rightarrow O_2+2H_2O+4e^- \quad (7)$$

Alternatively, hydrogen oxidation, an organic oxidation or water oxidation is undertaken as the oxidation reaction.

During operation of the electrolyzer, liquid products may accumulate in the cathode outlet as they are generated by the cathode. Alternatively, the products generated at the cathode may pass across the central membrane or separator 202 of the electrolyzer to the anodic compartment where they accumulate in the anodic electrolyte. To isolate pure streams of the high value liquid product, purifiers or (separators) are used to separate the liquid products from MOH electrolyte (such as but not limited to NaOH, KOH, LiOH, and CsOH). Examples of separators that can be used in these systems are presented below.

In the example of FIG. 2, liquid products are separated from basic fluid streams that are obtained from both the cathode area 201 and the anode area 203, and the purified base is recirculated to the electrolyte on the anode side of the electrolyzer. In alternative approaches, the liquid products can be retrieved from a single area of the electrolyzer (e.g., only the cathode or only the anode). In alternative approaches, the liquid products can be retrieved from a separation area of the electrolyzer between the cathode area 201 and the anode area 203 which is not present in the example of FIG. 2. In the example of FIG. 2, two separate liquid streams are obtained from the electrolyzer and are fed to different separators. However, in alternative approaches, two or more liquid streams obtained from the electrolyzer can be sent to a single separator. In the illustrated case, the cathode area 201 is a gaseous phase area; and the liquid stream is obtained from the anode area using a gas-liquid separator 206. The gas-liquid product and the alcohol are passed to a gas-liquid separator 205.

Valuable products such as alcohols and carboxylic acids can be separated from an electrolyte using various approaches as disclosed herein, and a combination of any number of them can be used to attain the purity levels required for a specific application. Such methods include but are not limited to distillation, adsorption, crystallization, solvent extraction, and membrane separation. During distillation, heat is applied to the electrolyte to volatilize alcohols while retaining a larger proportion of water in the condensed phase. The volatilized alcohols can be collected via condensation. During adsorption, the electrolyte is passed through an adsorbent material in a column such as but not limited to activated charcoal, molecular sieves, silica gel, clay, diatomaceous earth, polymer foams, resins, and particles, carbon nanotubes, ion exchange resins, cellulose, and others. One component of the electrolyte, such as alcohol, carboxylic acid, or water, selectively adsorbs onto the adsorbent, producing a purified stream at the outlet of the adsorbent column. During crystallization, the electrolyte is concentrated and cooled to a low temperature to selectively precipitate components such as metal carboxylates and metal hydroxides as solids, while retaining alcohols in the liquid phase. Purification is then achieved by removing the solids from the cooled mixture. During membrane separation, the electrolyte is passed through a selective membrane that permits one or more components of the mixture to pass more readily than others. Membrane separation uses an extended surface comprising a polymeric species for the movement/restriction of a particular species in a fluid line. The separator may comprise several layers of the membrane surface to achieve effective separation. On a commercial scale, the membrane can be arranged as a hollow fiber module, a spiral wound module, or some other form. The separation is achieved through a favorable chemical interaction of the membrane with the substance to be removed from the fluid line or through a size of pore tailored for the exclusion of larger molecules within the fluid.

In specific embodiments of the invention, the electrolyte can be acidified before or after distillation to facilitate product separation. For example, an alkaline mixture containing metal carboxylates, metal hydroxide, and alcohols can be subjected to distillation to remove a part of the alcohols, but not metal carboxylates or metal hydroxides present in the mixture. Subsequently, the alcohol-poor alkaline mixture can be acidified to convert the metal carboxylate and metal hydroxide to carboxylic acids and water, respectively. This mixture can then be subjected to another distillation process to remove the carboxylic acids from the mixture, yielding separate, high-purity streams of alcohol, carboxylic acids, and water with metal salts. Without acidification, it is difficult to separate metal carboxylate salts from water using distillation because metal carboxylate salts are not volatile. This may impose a larger energy demand because of the requirement to crystallize the metal carboxylate from the processed electrolyte mixture.

In specific embodiments of the invention, a reactive distillation process can also be used to purify the electrolyte stream and reduce total energy demand. As a non-limiting example given by equation 8 below, acid equivalents can be added to the spent electrolyte to acidify the metal carboxylates, and a catalyst can be used while heating the electrolyte mixture to induce esterification of carboxylic acids with alcohols in the electrolyte (e.g., esterification of acetic acid with ethanol to produce ethyl acetate). As the reaction proceeds, a larger proportion of the carboxylic acid is combined with alcohols to produce a volatile organic ester. By esterifying carboxylic acids with alcohols, reactive distillation provides a route for the carboxylic acid to be effectively separated from the bulk water at a lower temperature than is required to volatilize the carboxylic itself, potentially lowering the energy demand of the overall separation process chain.

$$CH_3COOH+CH_3CH_2OH \rightarrow CH_3CO_2CH_2CH_3 \quad (8)$$

In specific embodiments of the invention, solvent extraction can also be used to separate alcohols and carboxylic acids from electrolyte. During solvent extraction, an organic extracting agent containing one or more solvents such as but not limited to an organic ester, an organic amine-containing molecule, an alcohol, an organic ether, or a hydrocarbon compound is added to the electrolyte mixture containing carboxylic acids and alcohols. During mixture, the carboxylic acids and alcohols dissolve in the organic extraction agent and leave the aqueous electrolyte phase. The carboxylic acids and alcohols are then removed from the organic extraction agent via any number of methods, such as but not limited to distillation, and the organic extraction agent can then be recovered for reuse to extract more product from the aqueous electrolyte stream.

The separation process discussed herein can separate organic ions from the basic liquid streams without using as much energy as alternative approaches. For example, the separation processes can operate to separate organic ions from the basic liquid streams without acidifying the base. These approaches contrast with alternative approaches which require a large amount of energy to generate enough protons to entirely acidify the base in the liquid stream. For example, the processes can instead operate on the principles of electrodialysis in which protons can be recycled between the anode and cathode of the electrolyzer used for the electrodialysis. As another example, the processes can instead operate on the principles of selective binding in which an acid is used to convert the carboxylate salts into carboxylic acid, where the acid can be recovered using low energy electrodialysis. Both examples used in this paragraph include separation processes which include an electrodialysis process. However, additional separation processes disclosed in this specification do not utilize electrodialysis.

Electrodialysis Separator Processes

In specific embodiments, the separation process is an electrodialysis process. The process can utilize an electrolyzer where the liquid stream is applied to the anode area or the cathode area of the electroylzer. For the avoidance of doubt, the electrolyzer in the electrodialysis separator is different than the electrolyzers mentioned in the previous section (i.e., the electrolyzer from which the liquid stream is obtained). First and second streams can be obtained from the electrolyzer where the first stream and the second stream are separate. The separation process separates a volume of a cation from the liquid stream. The cation could be an ionic form of a metal (M) such as potassium, sodium, cesium, or lithium. The first stream includes a second volume of the base. The second stream includes a volume of an organic acid. The organic acid could be carboxylic acid. The volume of the organic acid includes the volume of the organic anion. The second volume of the base can include the volume of the cation. In specific embodiments of the invention, the electrodialysis separator uses water as a feedstock and produces dihydrogen and dioxygen. The dihydrogen or dioxygen can be valorized in a separate process or via recirculation into the same or a separate separator. For example, the dihydrogen can be used to generate a protonating species to be used by the electrodialysis separator or can be used as an energy source for the electrolyzer from which the liquid stream is being harvested.

Figure 3:
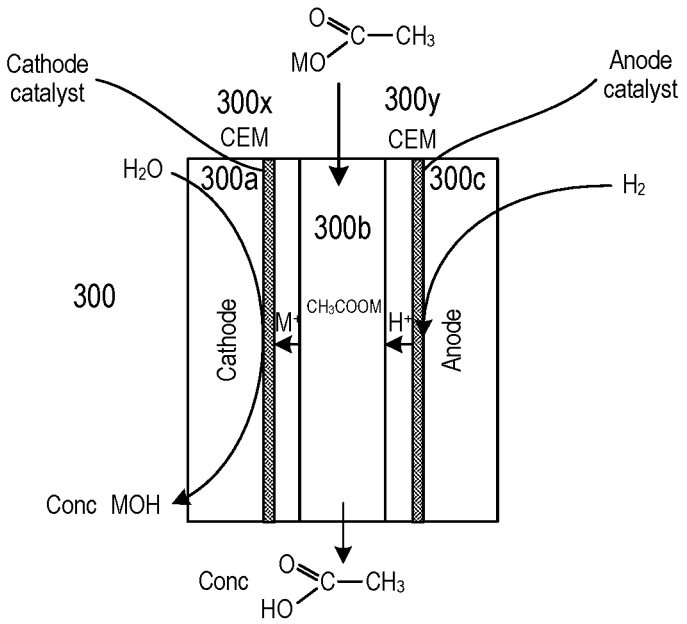
FIG. 3 illustrates an electrodialysis separator using cation exchange membranes in accordance with specific embodiments of the inventions disclosed herein.
Figure 3:
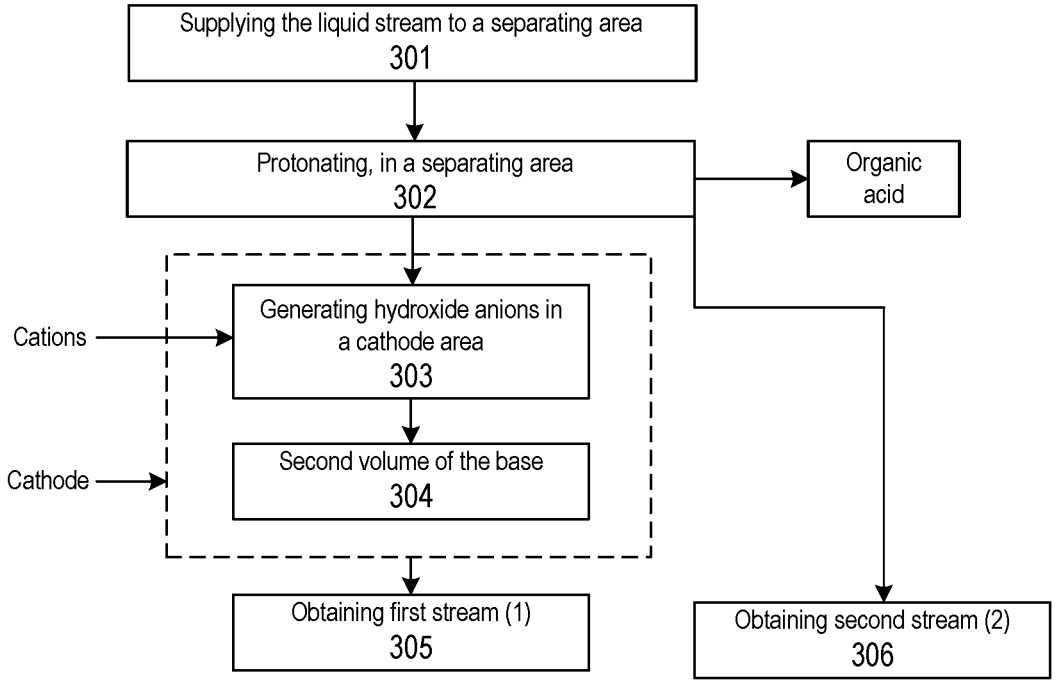

FIG. 3 illustrates an electrodialysis electroylzer 300 that can be used to separate useful products from a liquid stream, and/or to refresh an electrolyte by removing byproducts, in accordance with embodiments disclosed herein. As illustrated, an anode area 300*c* of the electrodialysis electrolyzer is isolated from the separating area 300*b* of the electrodialysis electrolyzer by a cation exchange membrane 300*x*, the separating area 300*b* of the electrodialysis electrolyzer is located between the anode area 300*c* of the electrodialysis electrolyzer and the cathode area 300*a* of the electrodialysis electrolyzer 300, and the cathode area 300*a* of the electrodialysis electrolyzer 300 is isolated from the separating area 300*b* of the electrodialysis electrolyzer 300 by a second cation exchange membrane 300*y*.

FIG. 3 also includes a flow chart 310 for a set of separation processes including the steps of supplying the liquid stream to a separating area of an electrodialysis electrolyzer 301, protonating 302, in the separating area and using a volume of a protonating species, the volume of the organic anion to generate the volume of the organic acid, and generating a volume of hydroxide anions in a cathode area of the electrodialysis electrolyzer 303. In accordance with these steps, the volume of hydroxide anions and the volume of cations combine in the cathode area of the electrodialysis electrolyzer to generate the second volume of a base in the cathode area of the electrodialysis electrolyzer 304. The flow chart continues with a step of obtaining a first stream (1) from the cathode area of the electrodialysis electrolyzer 305 and obtaining a second stream (2) from the separating area of the electrodialysis electrolyzer 306. The first stream can be a concentrated stream of base that can be used as the electrolyte for an electrolyzer that generated the liquid stream which was applied to the separating area. The second stream can be a concentrated stream with an organic anion in the form of an organic acid. In the example of FIG. 3, the first stream is the output of the cathode area and is concentrated metal hydroxide, and the second stream is the output of the separating area and is concentrated carboxylic acid.

The separator processes described with reference to FIG. 3 can be used to separate any combination of an organic anion and base. The separator can also be integrated with an oxocarbon electrolyzer.

Figure 4:
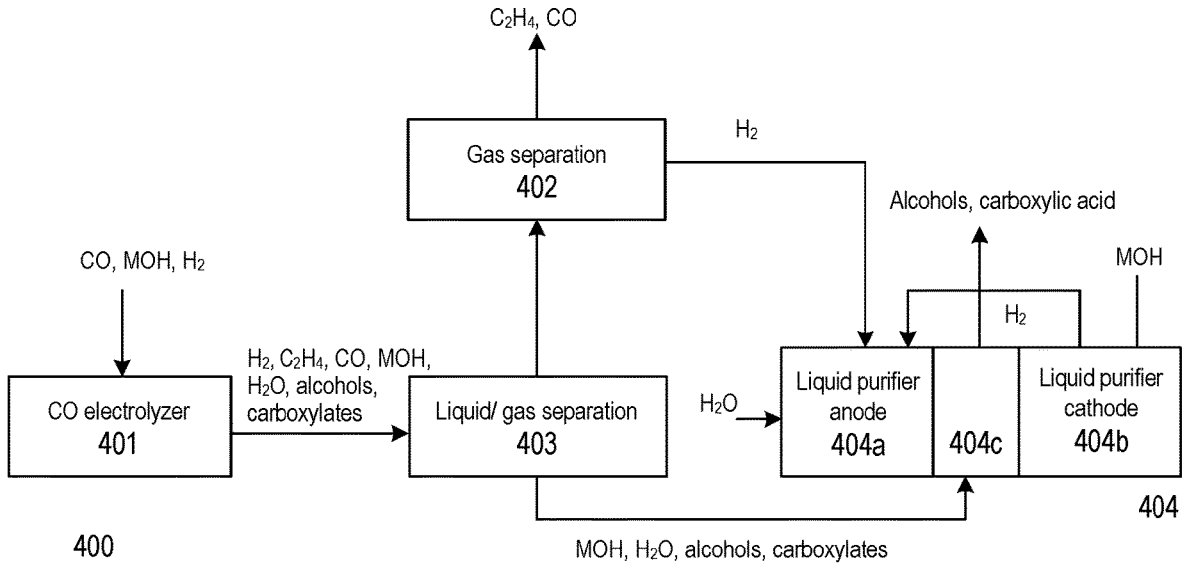
FIG. 4 illustrates an electrodialysis separator using cation exchange membranes integrated with a CO electrolyzer in accordance with specific embodiments of the inventions disclosed herein.

FIG. 4 illustrates a system 400 in which an electrodialysis electrolyzer 404 such as that illustrated in FIG. 3 has been integrated with a CO electrolyzer 401. The liquid products of a CO electrolyzer 401 can be separated from either the cathode output, anode output or both using a separator 404*c* such as the one presented in FIG. 3. A stream of MOH, water, alcohol and carboxylate is passed from a liquid/gas separation block 403 to a separator 404*c*. In FIG. 3, the separating area 300*b* conducts the separation/purification of acetic acid from an acetate/MOH stream, however this device could be used on any combination of organic anion and base. The separating area 300*b* uses cation exchange membrane 300*x*, cation exchange membrane 300*y*, and electrodialysis to concentrate a stream of acetic acid. Also, while not illustrated, dihydrogen is generated along with MOH at the cathode 404*b*. This example device uses cation exchange membrane 300*x* and cation exchange membrane 300*y* to facilitate the purification. The organic anion is protonated to form a neutral species from the transfer of a proton across a cation exchange membrane 300*y* next to the anode. The protons come from the anodic oxidation reactions. Selective movement of cation to the cathode (in this case M) through a cation exchange membrane 300*x* situated next to the cathode ultimately results in the isolation of carboxylic acid in the separating area. The hydroxide anion generated by the cathode then forms a concentrated stream of base, which then may be injected back into the electrolyte of the electrolyzer from the output of the cathode area.

In specific embodiments of the invention, the energy demands of the separating area 300*b* can be reduced by provisioning a substrate that is more reducible than water or protons, such as but not limited to one or more of dioxygen, nitrate, chlorine, bromine, metal ions, metal oxides, and/or metal complexes. The more reducible substrate can be advantageously derived from an abundant upstream source, such as waste streams and/or the output of an electrolyzer. For example, dioxygen can be provided to the separator from an upstream CO electrolyzer, valorizing the dioxygen produced by the CO electrolyzer and lowering the energy demand of the separator. In the case of provisioning dioxygen to the separator's cathode, the standard cell potential of the separator is made more exergonic by −118.7 KJ/mol $CH_3COO^-$ (1.23 V) because the standard reduction potential of $O_2$ is 1.23 V more positive than that of $H_2O$.

In specific embodiments of the invention, excess hydrogen gas sourced from another process (such as but not limited to polymerization, electrolysis, hydrocarbon reforming) is used to reduce the energy demand of the purification system. If the electrolyzer generates hydrogen at the cathode 404*b* as a by-product, this hydrogen gas may be injected into the purifier to be oxidized as shown in FIG. 3 (the dihydrogen delivered to the anode) and FIG. 4 (the dihydrogen from the gas separation 402 block to the anode of the electrodialysis electrolyzer). Dihydrogen generated at the cathode 404*b* of the separator/purifier may also be recycled to the anode 404*a* to lower the energy consumption of the device. It has not been obvious to integrate parasitic dihydrogen into an electrodialysis process because it is typically uneconomical to do so. In specific embodiments of the invention, the electrodialysis system represents a method to extract value from dihydrogen that cannot otherwise be valorized. For instance, valorizing dihydrogen into commercial grade may require other downstream capital equipment and process steps, such as compression and transportation, that may be prohibitive to implement for the operator of a carbon monoxide electrolysis plant. Thus, the energy losses associated with generating parasitic dihydrogen during CO electrolysis can be partially recovered using the electrodialysis unit while simultaneously reducing the exogenous dihydrogen and power demand of the electrodialysis process, translating to process synergy.

Figure 5:
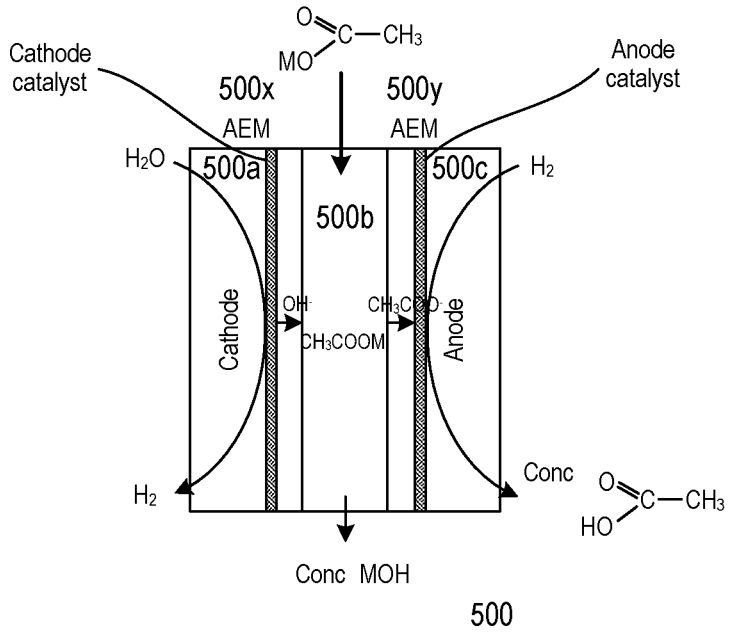
FIG. 5 illustrates an electrodialysis separator using anion exchange membranes in accordance with specific embodiments of the inventions disclosed herein.
Figure 5:
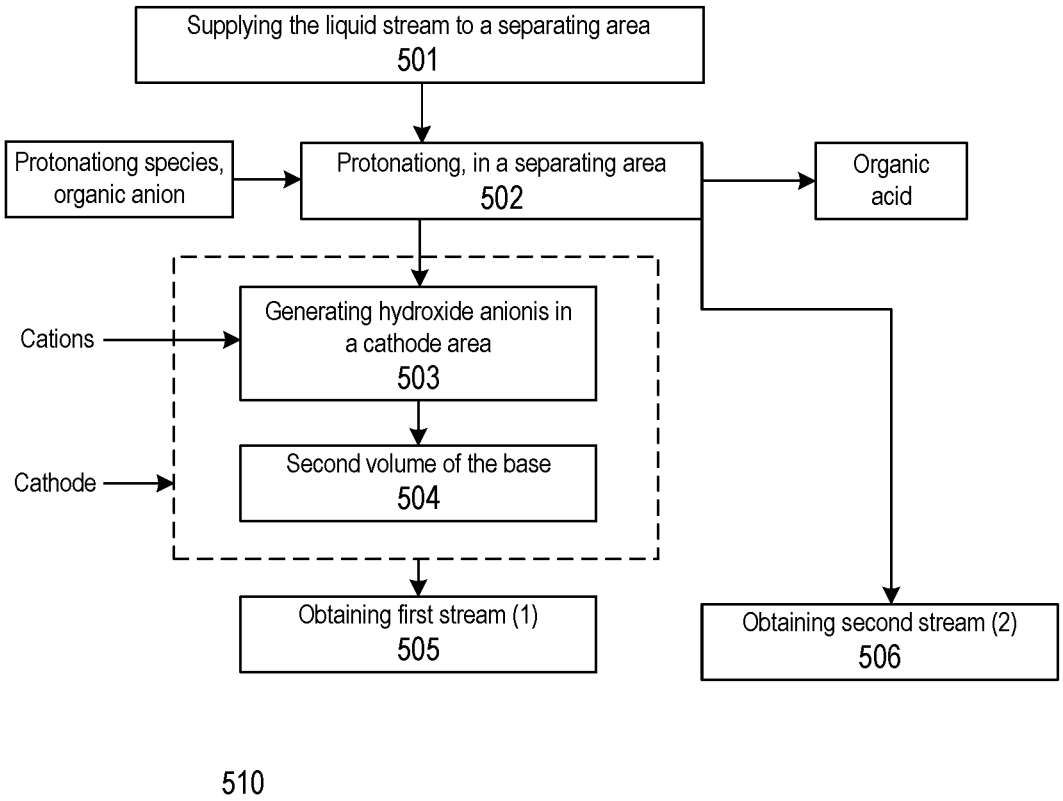

FIG. 5 illustrates an electrodialysis electrolyzer 500 that can be used to separate useful products from a liquid stream, and/or to refresh an electrolyte by removing byproducts, in accordance with embodiments disclosed herein. As illustrated, the anode area 500*c* of the electrodialysis electrolyzer is isolated from the separating area 500*b* of the electrodialysis electrolyzer by an anion exchange membrane 500*y*, the separating area 500*b* of the electrodialysis electrolyzer 500 is located between the anode area 500*c* of the electrodialysis electrolyzer 500 and the cathode area 500*a* of the electrodialysis electrolyzer 500, and the cathode area 500*a* of the electrodialysis electrolyzer 500 is isolated from the separating area 500*b* of the electrodialysis electrolyzer 500 by a second anion exchange membrane 500*x*.

FIG. 5 also includes a flow chart 510 for a set of separation processes including the steps of supplying the liquid stream to a separating area of an electrodialysis electrolyzer 501, protonating, in an anode area of the electrodialysis electrolyzer 502 and using a volume of a protonating species, the volume of the organic anion to generate the volume of the organic acid, and generating a volume of hydroxide anions in a cathode area of the electrodialysis electrolyzer 503. The volume of hydroxide anions and the volume of cations combine to generate the second volume of the base in the cathode area of the electrodialysis electrolyzer 504. The flow chart also includes the steps of obtaining a first stream from the separating area of the electrodialysis electrolyzer 505 and obtaining a second stream from the anode area of the electrodialysis electrolyzer 506. The first stream can be a concentrated stream of base that can be used as the electrolyte for an electrolyzer that generated the liquid stream which was applied to the separating area. The second stream can be a concentrated stream with an organic anion in the form of an organic acid. In the example of FIG. 5, the first stream is the output of the separating area and is concentrated metal hydroxide, and the second stream is the output of the anode area and is concentrated carboxylic acid.

In this example, the liquid products are separated from either the cathode output, anode output or both through the separator presented in FIG. 5 for the separation/purification of acetic acid from an acetate/MOH stream. However, this device could be used on any combination of organic anion and base. FIG. 5 provides an example of a separator that can be used downstream of a CO electrolyzer that uses anion exchange membranes (AEMs), such as anion exchange membrane 500*x* and anion exchange membrane 500*y*, and electrodialysis to concentrate a stream of acetic acid. The device uses anion exchange membrane 500*x* and anion exchange membrane 500*y* to facilitate the purification. The organic anion is protonated to form a neutral species as it transfers from the central stream through the anion exchange membrane to the anode. The protons come from anodic oxidation reactions. Selective movement of hydroxide generated at the cathode through the other anion exchange membrane 500*x* situated next to the cathode then generates a central channel containing concentrated base, which then may be injected into the electrolyte of the electrolyzer. If the electrolyzer generates hydrogen at the cathode as a by-product, this gas may be injected into the separator to be oxidized at the anode. Dihydrogen generated at the cathode of the separator may also be recycled to the anode to lower the energy consumption of the device. This separator can be used in a similar configuration to FIG. 4, but with different outputs from the electrolyzer compartments (e.g., the base will be recovered from the separator area).

Figure 6:
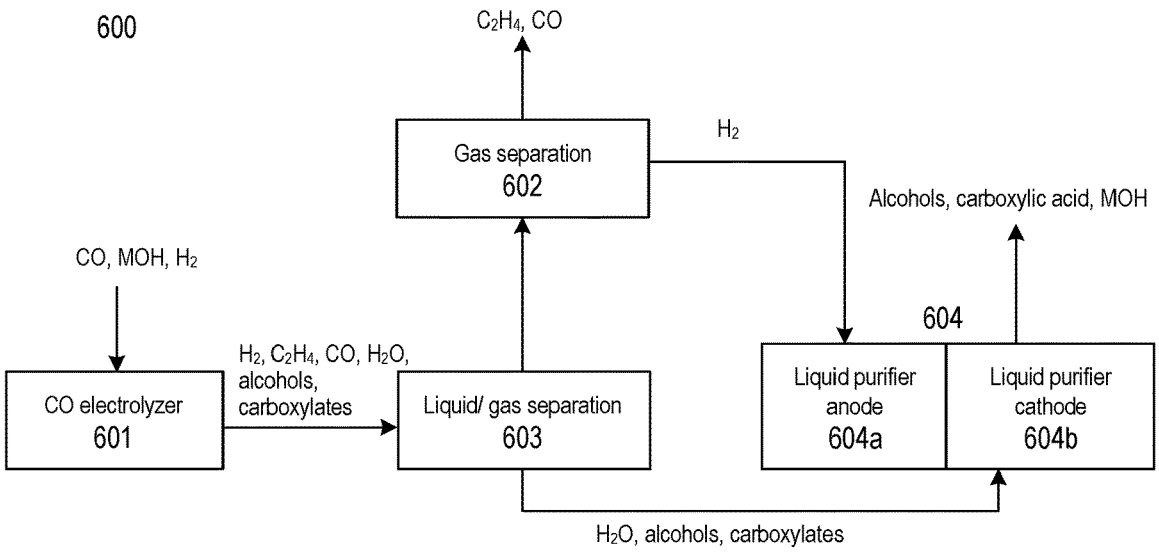
FIG. 6 illustrates an electrodialysis separator using anion exchange membranes integrated with a CO electrolyzer in accordance with specific embodiments of the inventions disclosed herein.
Figure 6:
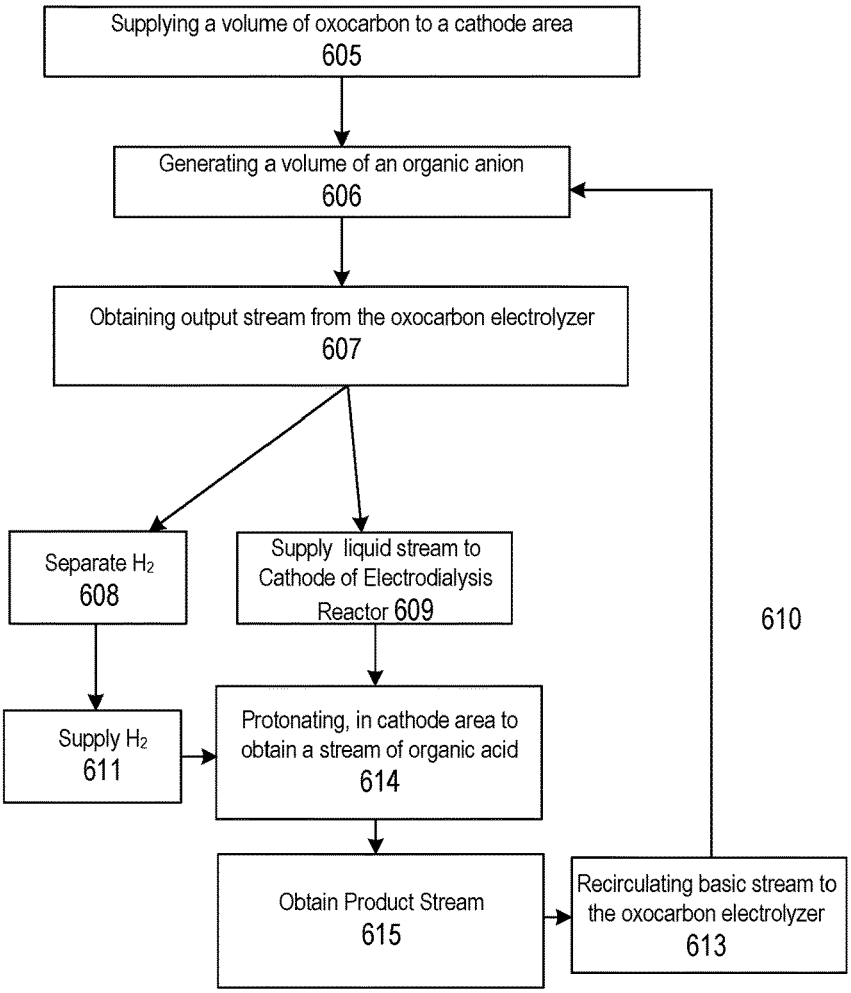

FIG. 6 provides an example of a system 600 with a separator for an oxocarbon electrolyzer 601 electrolyte using electrodialysis where the electrodialysis electrolyzer does not include a central separator area. FIG. 6 also includes a flow chart 610 for set of methods that can be practiced by system 600. The flow chart includes a step of supplying a volume of oxocarbon carbon to a cathode area of an oxocarbon electrolyzer to be used as a reduction substrate 605, a step of generating a volume of an organic anion using the reduction substrate 606, and a step of obtaining an output stream with a volume of dihydrogen from the oxocarbon electrolyzer 607. The output stream includes the volume of the organic anion. In the illustrated case, the organic anion is a carboxylate. The flow chart also includes a step of supplying a separating a volume of dihydrogen from the output stream 608 and supplying the volume of dihydrogen to an anode area of the electrodialysis electrolyzer 611. The flow chart also includes a step of supplying the second liquid stream to a cathode area of an electrodialysis electrolyzer 609. The flow chart also includes a step of protonating, in the cathode area and using a volume of protons from the volume of dihydrogen, a volume of the organic anion to generate a volume of an organic acid 614 and obtaining a product stream from the cathode area of the electrodialysis electrolyzer 615. The product stream includes the volume of the organic acid which has been converted from carboxylates by the electrodialysis electrolyzer 604. Further, while not shown, a basic stream can be recovered from the product stream using the approaches disclosed herein and recirculated to the oxocarbon electrolyzer in a step 613. The basic stream can be an electrolyte of the electrolyzer with a PH that has been lowered owing to the removal of byproducts from the electrolyte, or it can be a basic fluid that can be used to refresh the electrolyte.

In specific embodiments of the invention, the separation processes include providing dihydrogen into the anode compartment 604*a* of a separator 604 such as the separator in FIG. 6. Such approaches can obviate the use of a central compartment to cause the separation and thus lower the energy requirement of the separation. Operating without a central compartment can reduce the ohmic loss of the separator thereby resulting in lower energy consumption. In these embodiments, the liquid stream with the organic anion can instead be fed into the cathode compartment 604*b* of the electrodialysis electrolyzer from liquid/gas separator 603 while dihydrogen can be provisioned into the anode compartment 604*a* of the separator 604 from the gas separation unit 602. During operation, protons produced by the anodic oxidation of water or dihydrogen from the anode compartment can migrate across the membranes and into the cathode compartment 604*b*, where the protons can recombine with the carboxylate. Embodiments without a central separator compartment would be well suited to a system that uses a carboxylate-rich and metal hydroxide-poor solution as its feedstock to produce a concentrated stream of carboxylic acid at the separator outlet.

As shown in FIG. 6, the gas separation unit 602 can provide hydrogen that is obtained from the CO electrolyzer. Accordingly, the flow chart also includes steps of generating a volume of output gas using the reduction substrate, separating the liquid stream from the volume of output gas using a liquid-gas separator, and separating the volume of dihydrogen from the volume of output gas. This is the volume of dihydrogen that can be supplied to the anode of the electrodialysis electrolyzer 611 as in the illustrated example. The approach provides the same benefits as mentioned above with respect to FIG. 4.

Selective Binding Separator Processes

In specific embodiments of the invention, the separating processes disclosed herein can be conducted using the principle of selective binding. In the following discussion, acetate (OAc) is used as an example of an organic anion that can be separated from a base in a liquid stream using the principle of selective binding. However, the approaches disclosed herein are more applicable to other organic anions including any carboxylate. In the following discussion any anion (A−) such as but not limited to $Cl^-$, $Br^-$, $NO_3^-$, $PO_4^{3-}$, etc. can be used to take advantage of the principle of selective binding to remove the anion from the basic liquid stream as will be disclosed in the following discussion. The separation processes involve introducing a liquid stream to an ion-exchange environment having an adsorbent positively charged material. For example, the ion-exchange environment could be a column packed with the adsorbent positively charged material. The ion-exchange environment could include a cationic resin. The adsorbent positively charged material can include materials such as but not limited to anion exchange resins, polymeric adsorbent materials, zeolites, activated carbon, nanoparticles, metal organic frameworks, molecular sieves, alumina, silica gel, and many other substances capable of adsorption.

Figure 7:
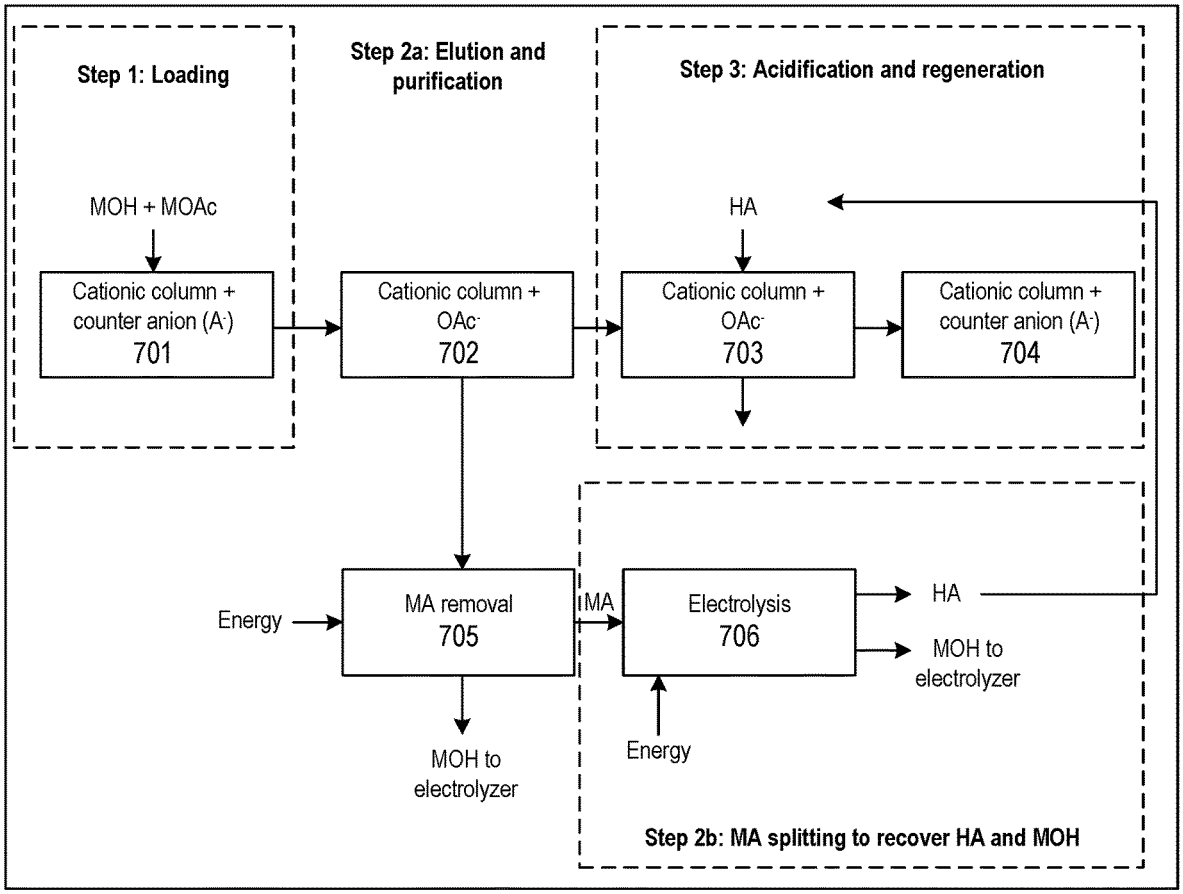
FIG. 7 illustrates a flow chart for a set of methods using a selective binding separator process in accordance with specific embodiments of the inventions disclosed herein.
Figure 8:
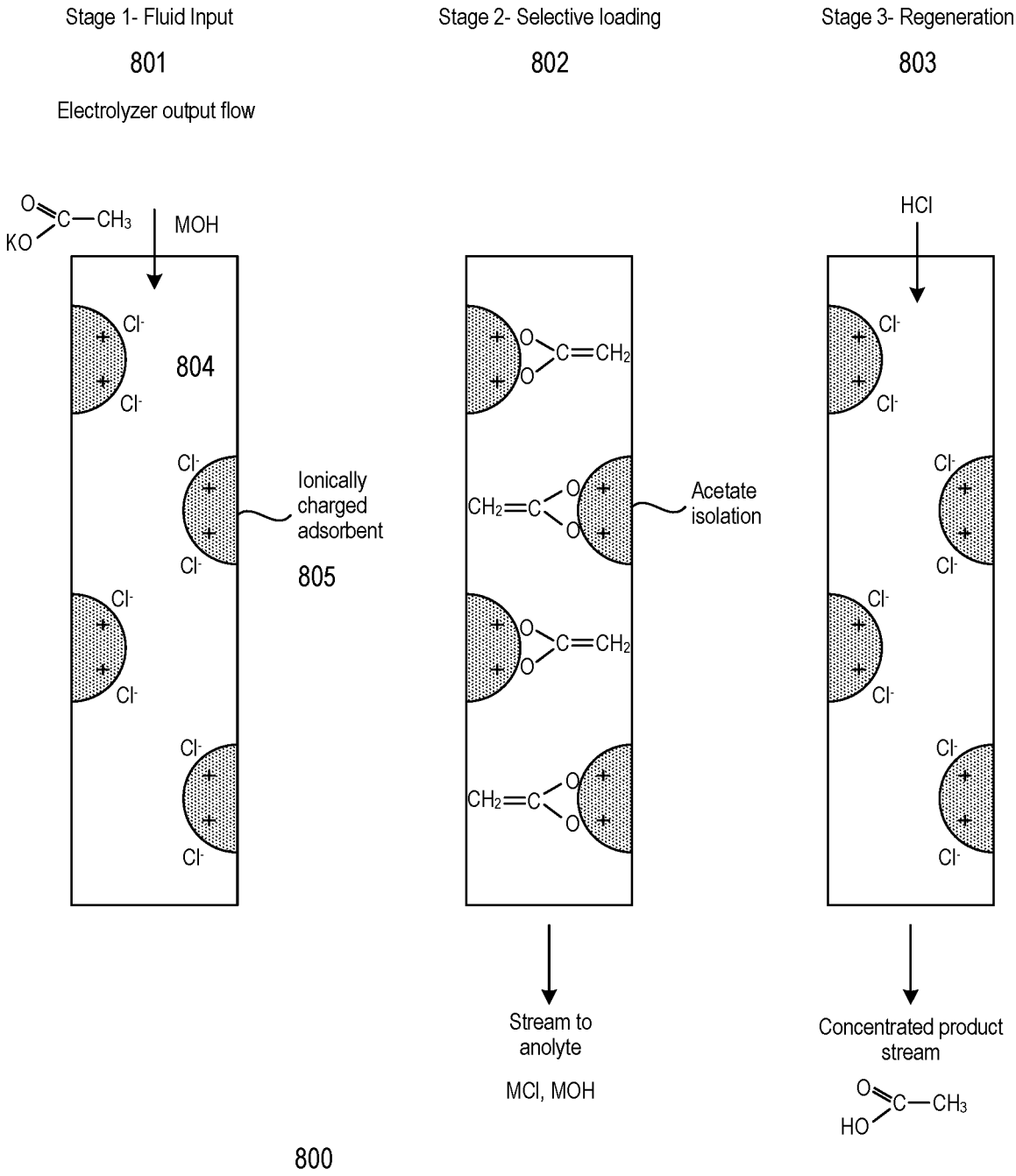
FIG. 8 illustrates different phases of operation for an ion-exchange column in a selective binding separator process in accordance with specific embodiments of the inventions disclosed herein.

Ion exchange onto a cationic material that is selective for either acetate or hydroxide could affect the separation of a mixed stream of a carboxylate and MOH. FIG. 7 illustrates a flow chart 700 for a set of methods that illustrate this concept. FIG. 8 illustrates an ion-exchange column as it progresses through a method that is in accordance with flow chart 700. In a first step, a fluid stream containing MOAc and MOH is first applied to an ion-exchange environment such as an ion-exchange column 703 or ion-exchange adsorption-bed containing cationic material 704 and an anionic counter ion A" of a strong acid 701. The fluid stream could be an output electrolyte stream from an oxocarbon electroylzer such as the CO electrolyzers discussed above. The MOH could be separated to increase the pH of the electrolyzer, the MOAc could be harvested as part of harvesting useful products from the system, the MOAc could also be removed for purposes of keeping the pH of the electrolyzer high. In the example of step 1 of FIG. 7 and phase 801 in FIG. 8, the fluid stream is applied to an ion-exchange column containing the cationic material. In the example of FIG. 8, the anionic counter-ion is $Cl^-$. Preferably, in embodiments in which this separating process is being used in combination with a CO electrolyzer, the counter-ion is chosen such that it is compatible with the operation of the CO electrolyzer (e.g., $SO_4^{2-}$ or $ClO_4^-$).

In a second step, the two salts MOH and MA elute through the adsorption-bed or column and are separated. As the MOAc and MOH pass through the column, one species is selectively adsorbed over the other (for example $OAc^-$) yielding a purified electrolyte stream consisting of MOH and the MA (e.g., $Na_2SO_4$ or $KClO_4$) of the anion initially loaded into the column. A step such as nanofiltration or crystallization can be employed to remove MA from the mixed MA/MOH stream 705. This process is illustrated by step 2*a* in FIG. 7 and phase 802 in FIG. 8. As seen in FIG. 8, a first stream containing MCI and MOH are withdrawn from the column in this phase. The MCI can then be filtered out to produce a first stream that can be used to increase the pH of the electrolyte in an integrated CO electrolyzer.

In specific embodiments, an intermediate salt-splitting or electrodialysis step 706 is used to recover acid and base equivalents from the MA salt produced in the previous step, as illustrated in step 2*b*. This process is not illustrated by an implementation in FIG. 8, but an implementation does appear as step 2*b* in FIG. 7. In the illustrated step, MA is split into HA and MOH via electrodialysis and the application of energy. In embodiments in which the separator is integrated with a CO electrolyzer, the MOH could be circulated to increase the pH of the electrolyte of the CO electrolyzer. The HA can also be used to recover the anionic counter-ions that were used to prepare the ion-exchange environment at the beginning of the process.

In specific embodiments, a strong acid is provided to the ion-exchange environment to yield a concentrated carboxylic acid stream and to regenerate the ion-exchange environment. The concentrated carboxylic acid stream could be the second stream referenced above in the discussion of separators for CO electrolyzers. As illustrated by step 3 in FIG. 7 and phase 803 in FIG. 8, acetic acid is obtained by providing a strong acid HA such as but not limited to HCl, $H_2SO_4$ or $KClO_4$ to the column, yielding a concentrated acetic acid solution and regenerating the ion-exchange column 703. In the example of phase 803 in FIG. 8, the strong acid is HCl.

As can be seen from the example in FIG. 7 the tandem ion exchange/electrodialysis approach minimizes the wasteful acidification of unconverted MOH, enabling its recovery for recirculation into the CO electrolyzer.

In embodiments in which the ion-exchange columns 800 of FIG. 8 are integrated with a CO electrolyzer, the liquid products can be separated from either the cathode output, anode output or both through the separator presented in FIG. 8 for the separation of acetic acid from an acetate/MOH stream, however this device could be used on a fluid stream having any combination of an organic anion and base.

The separation efficiency of MOH to carboxylate or any other organic anion relies on the selective adsorption of the organic anion onto the cationic material. The material (e.g., resins) can be provided as small beads that can be packed in a column or laid out on a fixed bed. The process separation efficiency can also be increased through the use of multiple or longer columns or beds which can improve the purity of the MOH stream produced during the loading step, depending on relative affinity. Unfunctionalized high-surface area materials such as zeolites and alumina can also be used as a column material, relying on selective physisorption of acetate.

As mentioned previously, in embodiments in which the separator is integrated with a CO electrolyzer, the anion $A^-$ (and corresponding conjugate acid HA for the acidification) should be selected so that it does not interfere with the operation of the CO electrolyzer. Additionally, or in the alternative, steps should be taken to remove the anion prior to provisioning the first stream back to the electrolyzer. At steady state, the concentration of alkali metal salt can be adjusted prior to provisioning to the CO electrolyzer (e.g., with a method to remove the alkali metal salt such as crystallization or nanofiltration). In specific embodiments, an MA removal step may be necessary because multiple purification cycles will yield an electrolyte that has high MA and will result in a low degree of carboxylate adsorption in the cationic column 702. However, this salt removal process can incur substantial energy and water removal cost to crystallize and separate the two salts. The use of a removal method such as crystallization incurs the salt as a waste product during Step 2*a*. This motivates the use of another method to recover acid and base equivalents.

The choice of $A^-$ should also be made to assure that the cation material has a higher affinity for the organic anion that is meant to be separated (e.g., acetate) than for $A^-$ to enforce separation during loading. Furthermore, $A^-$ should be selected such that the MA salt has a substantially lower solubility than MOH to enable MA removal using crystallization. Furthermore, small amounts of MA salt should be compatible with the CO electrolysis and electrodialysis process, because the separations will be imperfect. For example, if the organic anion were acetate, then $A^-$ could be $KClO_4$ as it includes all these characteristics when applied to the separation of acetate.

This device uses a positively charged surface to facilitate the purification through the phases 801, 802 and 803 shown in FIG. 8. This high surface area interface selectively binds to the organic anions (acetate in the presented example), while letting through metal hydroxide electrolyte (e.g., KOH in water) and displacing the initially present anion (in this case $Cl^-$) 804. Upon saturation of this column with the organic anion, the column is isolated from the stream and an aqueous acidic solution such as but not limited to HCl, $HNO_3$, $H_2SO_4$, $HClO_4$, or HBr solution is fed through the column to generate the purified liquid product (acetic acid in this case) and regenerate the column to its starting state. Many of these columns may be run in parallel to ensure continuous purification of the aqueous streams.

In specific embodiments of the invention, the high surface area adsorbent is loaded with a cationic species 805 that induces the selective precipitation of a metal hydroxide, such as but not limited to a $Mg^{2+}$ and $Ca^{2+}$ to produce solid $Mg(OH)_2$ and $Ca(OH)_2$. During operation, a mixture of carboxylic acid and metal hydroxide in solution is passed through the adsorbent bed, where the hydroxide selectivity reacts with the cationic species to produce a solid on the adsorbent. Metal carboxylate is then produced in high purity at the outlet of the separator. To regenerate the separator for use, acid can be provisioned at the inlet of the separator to dissolve the precipitated metal hydroxide and restore the initial state of the adsorbent bed.

In specific embodiments of the invention, hydrogen generated at the cathode of an integrated CO electrolyzer is used as a feedstock to generate proton equivalents to protonate the organic anion. The proton equivalents can be generated from dihydrogen via a variety of means, such as but not limited to using the dihydrogen as a feedstock in an electrochemical cell to induce oxidation to protons or using the dihydrogen as a feedstock in a thermochemical process (such as HCl synthesis via the combination of $H_2$ and $Cl_2$) to produce an acid. If the electrolyzer generates hydrogen at the cathode as a by-product, this gas may be used to generate the acid for protonation of the organic anion.

Tubular Separation Reactor

Figure 9:
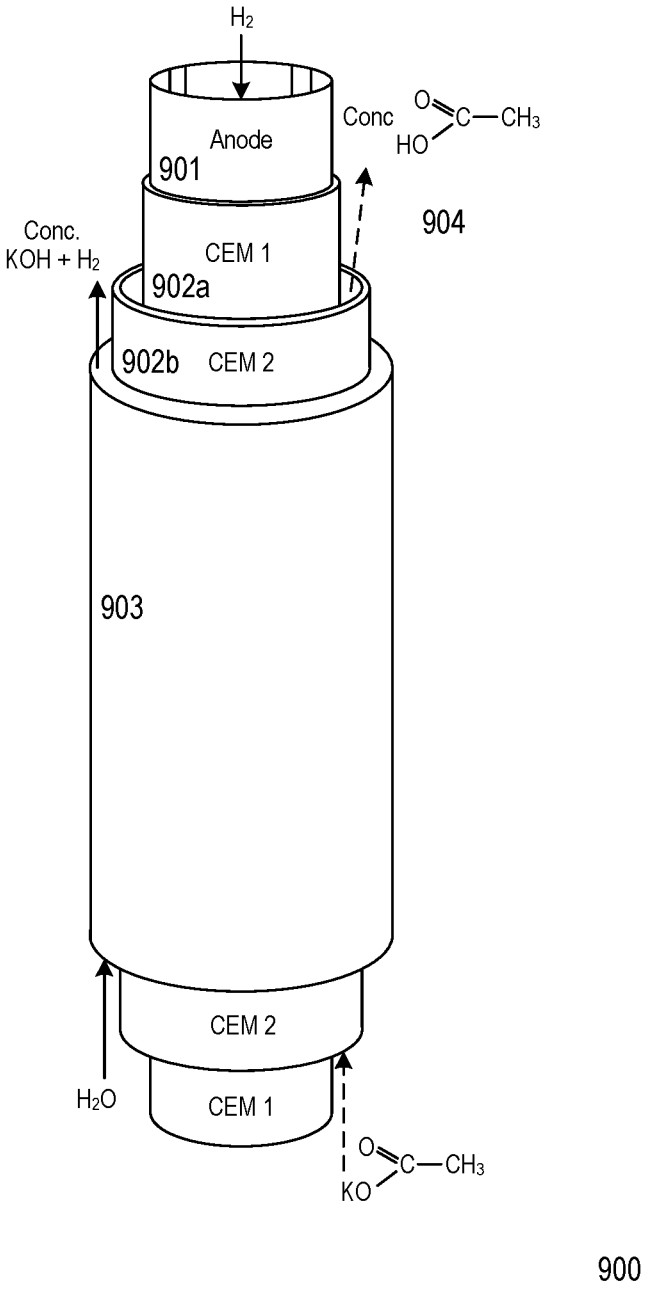
FIG. 9 illustrates a tubular electrodialysis electrolyzer in accordance with specific embodiments of the inventions disclosed herein.

In specific embodiments of the invention, the electrodialysis reactors above may be assembled in a tubular configuration to facilitate case of installation. An example of such an electrodialysis reactor is provided by tubular electrodialysis separator 900 in FIG. 9. Tubular configurations can allow for more efficient operation and lower costs because of favorable process parameters, such as but not limited to improved mass transport, reduced cell volumes, reduced energy expenditure, and case of assembly. FIG. 9 shows an example of the electrodialysis electrolyzer 300 described above being implemented in a tubular configuration. However, any of the electrodialysis reactors described above can be implemented as a tubular reactor.

FIG. 9 illustrates a tubular electrodialysis separator 900 that can be used to separate useful products from a liquid stream, and/or to refresh an electrolyte by removing byproducts, in accordance with embodiments disclosed herein. As illustrated, an anode area 901 of the electrodialysis electrolyzer is isolated from the separating area of the tubular electrodialysis separator 900 by a first cation exchange membrane 902*a*, the separating area 904 of the electrodialysis electrolyzer is located between the anode area 901 of the electrodialysis electrolyzer and the cathode area 903 of the tubular electrodialysis separator 900, and the cathode area 903 of the tubular electrodialysis separator 900 is isolated from the separating area 904 of the tubular electrodialysis separator 900 by a second cation exchange membrane 902*b*.

Nanofiltration Separator Processes

Figure 10:
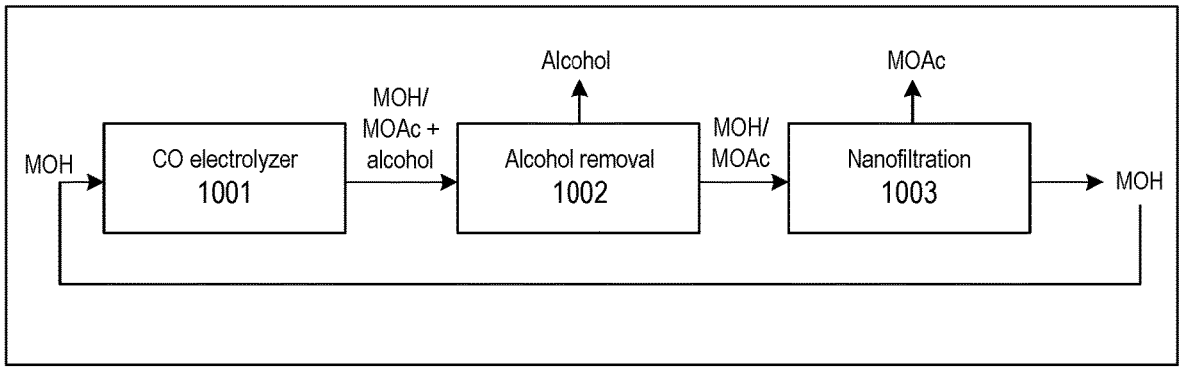
FIG. 10 illustrates a flow chart for a separator process using nanofiltration in accordance with specific embodiments of the inventions disclosed herein.

In specific embodiments of the invention, the separating processes disclosed herein can be conducted using the principle of nanofiltration. Nanofiltration can be used to separate MOH/MOAc streams departing an oxocarbon electrolyzer 1001. Nanofiltration 1003 is a membrane-based technology that separates components in solution using size and Donnan charge exclusion. An additional mechanism for separation is the dielectric exclusion imposed by differences in hydration energy of specific ions, such that ions with weaker hydration shells can pass through more easily. A simplified diagram applied for separating a MOH/MOAc solution separating a CO electrolyzer and alcohol removal 1002 is shown in FIG. 10. When fed a mixture of MOAc/MOH, a nanofiltration membrane could selectively retain MOAc while allowing MOH to pass through. Upon sufficient separation and concentration, the MOAc can be washed away from the membrane with water or simply diverted for downstream processing for valorization. One side of the membrane could be monitored for carboxylate concentration (or for the concentration of any organic anion) or MOH concentration, and the washing away could be conducted when the concentration passes a threshold by going above or below a target concentration. The nanofiltration membrane could be replaced with a reverse osmosis membrane to achieve the same effect.

Increased rates of nanofiltration can be driven by a pressure of 10-30 bar to force permeation. Retention efficiency of a solute on one side of the membrane decreases with concentration. This is advantageous if a single-pass anolyte feed is used and/or the crystallization yield is not worth the energy input of water removal. The energy input largely arises from the pressurization requirement of the headspace above the liquid being purified.

The materials used for nanofiltration are characterized by nanometric pores below 10 nm and can be made of polymeric materials such as PVDF, PET or polycarbonate, bio-derived materials such as cellulose, and nano porous metal arrays made of alumina. The membranes can also be composed of a combination of an active material such as polyamide or polyvinyl alcohol or sulfonated polyethersulfone and a support material such as polyester, polysulfone, or melamine polyamine.

Kolbe Electrolysis Separator Processes

In specific embodiments of the invention, the separating processes disclosed herein can be conducted using Kolbe Electrolysis. Reaction of carboxylate to ethane via Kolbe electrolysis can be used to support the separation of carboxylate from a basic fluid stream. Kolbe electrolysis can be performed to oxidatively decarboxylate two acetate molecules (and generally any carboxylate) to form ethane (see equations below). The same reaction mechanism provides a path to form propane from one acetate and one propionate, and butane from two propionates.

$$\text{Anode: } 2R{-}CO_2^-M \rightarrow 2R{-}CO_2 + 2e^- + 2M^+ \quad (9)$$

$$\text{Cathode: } H_2O + 2e^- + 2M^+ \rightarrow H_2 + 2MOH \quad (10)$$

$$\text{Follow up anode: } 2R{-}CO_2 \rightarrow R\cdot + 2CO_2 \quad (11)$$

$$\text{Follow up anode: } 2R\cdot \rightarrow R{-}R \quad (12)$$

$$\text{Carbonation: } 2CO_2 + 4MOH^- \rightarrow 2M_2CO_3 + 2H_2O \quad (13)$$

$$\text{Net w/ carbonation: } 2R{-}CO_2^-M + 2H_2O \rightarrow R{-}R + 2M_2CO_3 + 2H_2 \quad (14)$$

$$\text{Net w/o carbonation: } 2R{-}CO_2^-M + 2H_2O \rightarrow R{-}R + 2MOH + H_2 + 2CO_2 \quad (15)$$

Figure 11:
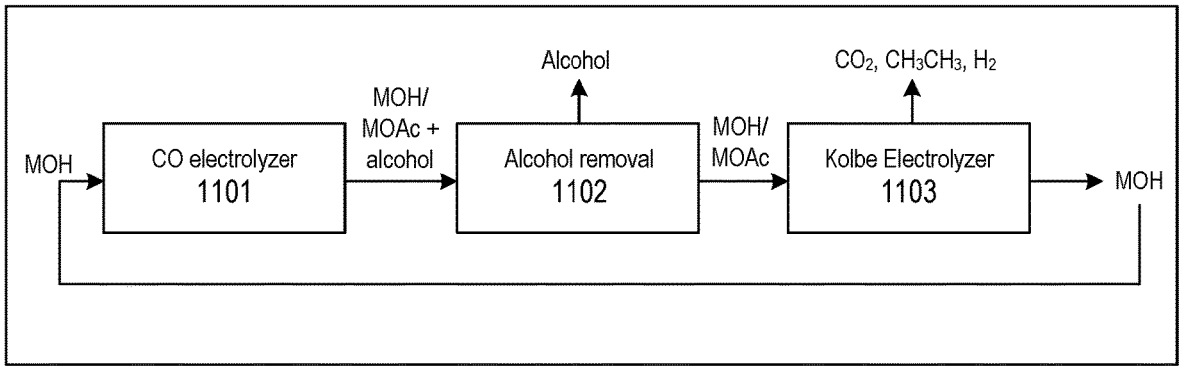
FIG. 11 illustrates a flow chart for a separator process using Kolbe electrolysis in accordance with specific embodiments of the inventions disclosed herein.

The reaction can be performed in aqueous media using a Pt anode and a $H_2$-evolving or $O_2$-reducing cathode. FIG. 11 illustrates a flow chart for a separation process using Kolbe electrolysis where the separator is integrated with an oxocarbon electrolyzer 1101. The anode of the Kolbe electrolyzer 1103 oxidizes acetate to form ethane. As the process occurs via the decarboxylation of acetate to produce $CO_2$, $CO_2$ is released at the anode. Depending on reactor configuration, this $CO_2$ can react with the $OH^-$ formed during $H_2$ evolution at the cathode, leading to the formation of carbonate/bicarbonate.

Another important side reaction is the two-electron oxidation of acetate to form the methyl carbocation instead of the radical intermediate, leading to the formation of methanol (see below). Methanol is an attractive product because it can be easily distilled from an aqueous MOH solution, and either valorized or upgraded to ethylene via the methanol-to-olefins (MTO) reaction.

$$\text{Anode: } 2R{-}CO_2^-M \rightarrow 2R^+ + 4e^- + 2CO_2 \quad (16)$$

$$\text{Cathode: } 2H_2O + 4e^- \rightarrow 2H_2 + 4MOH \quad (17)$$

$$\text{Homogenous: } 2R^+ + 2OH^- \rightarrow 2ROH \quad (18)$$

$$\text{Net w/ methanol formation: } 2R{-}CO_2^-M + H_2O \rightarrow 2ROH + H_2 + 2CO_2 + 2MOH \quad (19)$$

The efficiency of the Kolbe electrolysis process is favored in alkaline conditions, while the selectivity between the methanol and ethane pathway can be steered with the use of electrolyte additives.

The Kolbe cells can be designed such that $CO_2$ is rapidly removed from the solution to maintain alkalinity and minimize crossover. Otherwise, $M_2CO_3$ is produced as a waste product but can ultimately represent an equivalent of captured $CO/CO_2$ for the total process.

Figure 12:
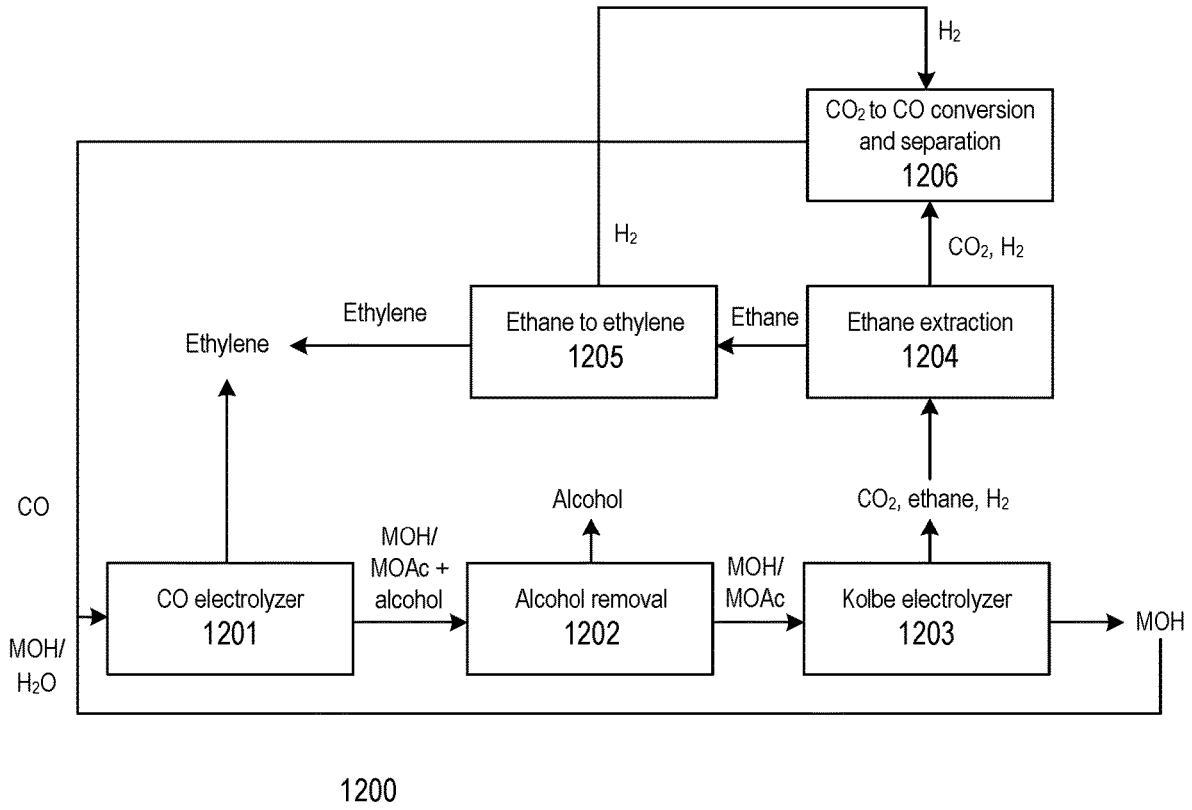
FIG. 12 illustrates a flow chart for a separator process using Kolbe electrolysis to produce ethylene in accordance with specific embodiments of the inventions disclosed herein.

The Kolbe electrolyzer 1103 produces a segregated and concentrated stream of MOH, which can be provisioned to the CO electrolyzer. The ethane (in addition to minority propane and butane) produced can be provisioned into a cracker to generate ethylene, propene, and butene. If carbonate/bicarbonate formation is rapid, this mixture can be separated from MOH in the alcohol removal apparatus block 1102 prior to provisioning it into the Kolbe electrolyzer 1103. If unreacted with hydroxide, the $CO_2$ can be provisioned along with the dihydrogen generated to a separate $CO_2$ to CO conversion unit that can be recirculated to supply the CO electrolyzer. As illustrated by system 1200 in FIG. 12, the $CO_2$ to CO conversion unit 1206 can be provided with dihydrogen from an ethane to ethylene conversion unit 1205 to power the process of $CO_2$ to CO conversion unit 1206. In the illustrated embodiment, the target valuable chemical produced by the CO electrolyzer 1201 is ethylene such that the separation process produces an additive quantity of such valuable chemical. Further, a mixture of MOH/MOAc and alcohol is passed through alcohol removal block 1202 to produce MOH/MOAc. The MOH/MOAc is then passed to a Kolbe electrolyzer 1203. After ethane extraction in ethane extraction unit 1204 $CO_2$ and $H_2$ are transferred to the $CO_2$ to CO conversion and separation.

Pyrolyzing Processes

Figure 13:
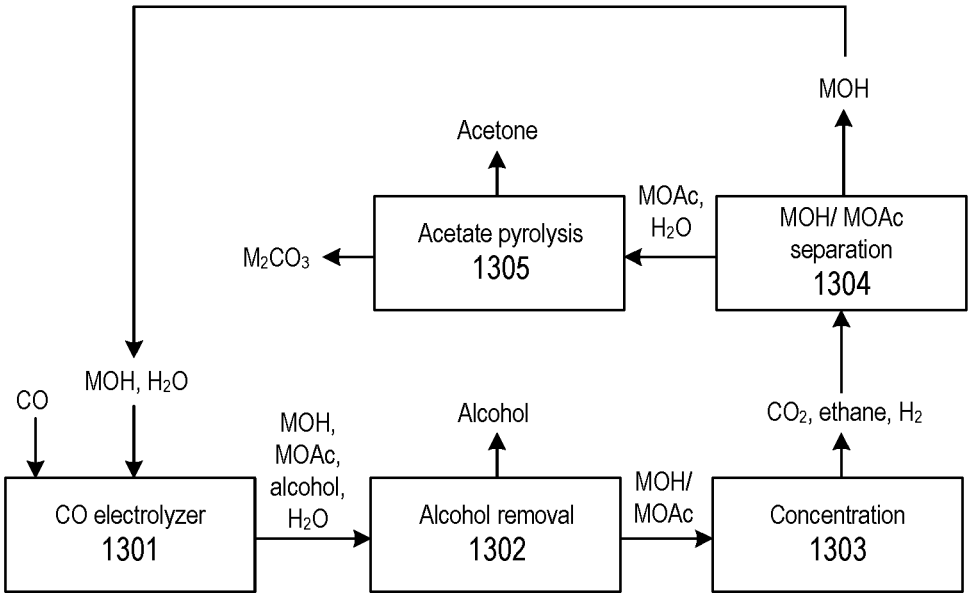
FIG. 13 illustrates a flow chart for a separator process that includes pyrolysis in accordance with specific embodiments of the inventions disclosed herein.

In specific embodiments of the invention, the separating processes disclosed herein can include a pyrolyzing separator process. In these embodiments, metal acetate and metal hydroxide can be separated, and the metal hydroxide can be recirculated to the CO electrolyzer 1301 to increase the pH of the electrolyte by MOH/MOAc separation block 1304. Furthermore, the metal acetate (or other carboxylate) can be pyrolyzed to produce higher value chemicals. For example, carboxylate products departing from the CO electrolyzer can be pyrolyzed to produce acetone. One route to produce acetone involves the pyrolysis of a metal acetate at 300-450° C. to form acetone 1305 (see reaction below, and FIG. 13). If performed on an impure MOH/MOAc solid solution (for example derived from a crystallization), the pyrolysis product will be a solid mixture of $M_2CO_3$ and MOH. Because $M_2CO_3$ are typically less soluble than MOH, the MOH can be dissolved with water prior to provisioning the pure MOH to the CO electrolyzer 1301. The $M_2CO_3$ can be treated as a waste product or taken as a captured $CO_2$ equivalent.

$$2M_2(CH_3COO)_2(s) \rightarrow M_2CO_3(s) + (CH_3)_2CO(g) \quad (20)$$

Conducting the acetate pyrolysis process 1305 to produce acetone requires the upstream removal of water from the MOH/MOAc electrolyte solution in concentration step 1303, along with an MOH/MOAc separation step to remove MOH from the MOAc. Before concentration step 1303, the stream can be passed through an alcohol removal step 1302 to remove alcohol.

Distinct Tanks for Separation Processes

In specific embodiments, fluid streams from a CO electrolyzer can be stored in multiple tanks or be sent to one of multiple separation units in order to allow the separation processes described above to operate more slowly than the demands of the CO electrolyzer would otherwise allow. The multiple separation units can be multiple ion-exchange columns, multiple Kolbe electrolyzers, multiple electrodialysis electrolyzers, etc. The tanks or separation units can be connected to the CO electrolyzer through a manifold with multiple values and control systems to route the fluid stream from a specific tank or separator at one time, and then to a separate tank or separator at another time. The separation units can also be connected to the CO electrolyzer through a manifold that will route the fluid stream to multiple separation units simultaneously. Many ion-exchange environments or other separation systems, such as separating columns, can run in parallel to ensure continuous purification of the aqueous streams.

Figure 14:
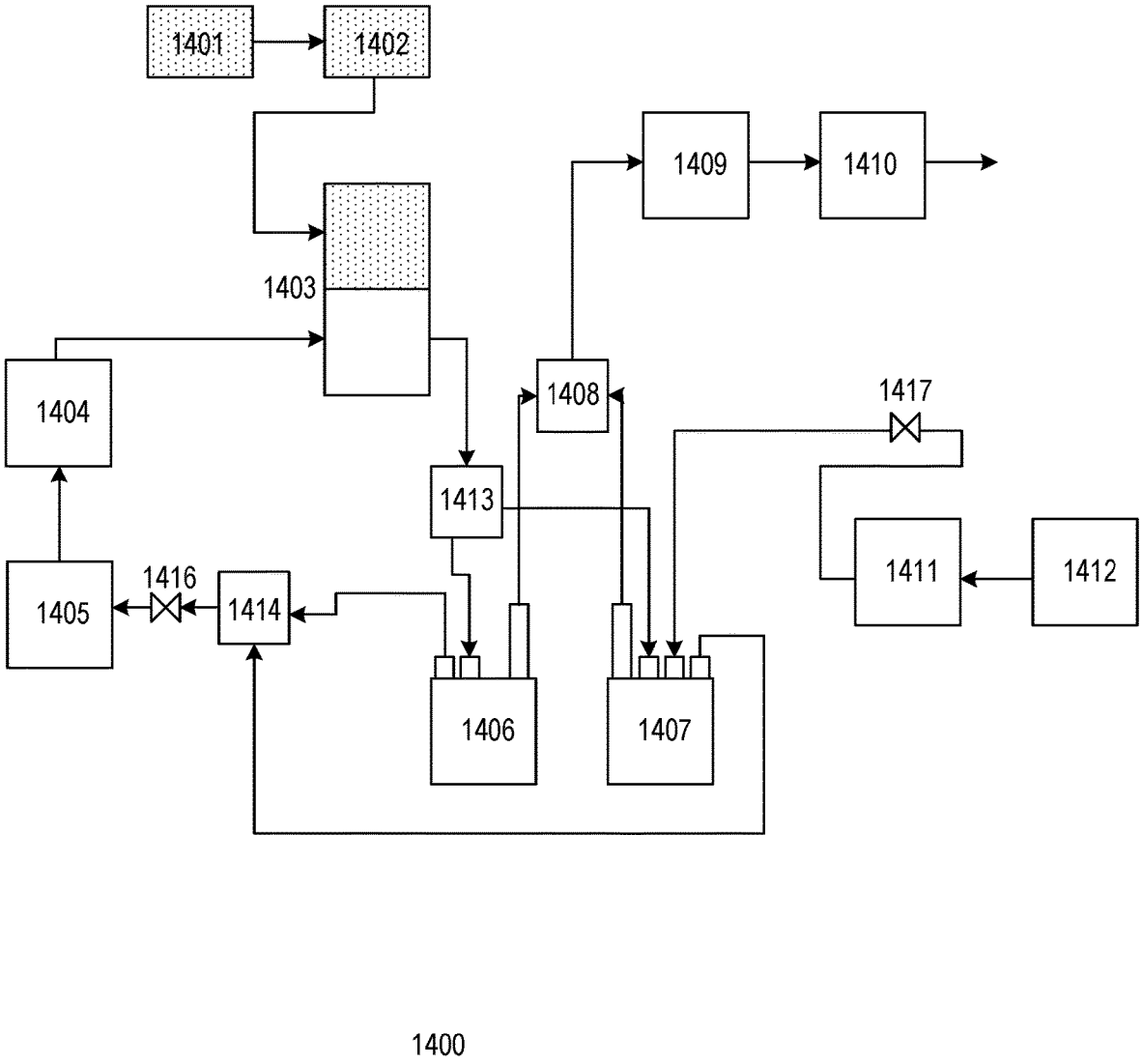
FIG. 14 illustrates a system using multiple tanks to store fluid streams in accordance with specific embodiments of the inventions disclosed herein.

FIG. 14 illustrates an electrolyte switching system 1400 to enable continuous operation and replacement of electrolyte for CO electrolyzer with multiple electrolyte tanks 1406 and 1407 where the electrolyte can be circulated from either of the tanks 1406 and 1407 or stored in the tanks temporarily for a separation process to be executed on the stored fluid. The separation process can be conducted as the fluid is withdrawn from the tank and then replaced into the tank or it can be conducted while the fluid is in the tank.

In specific embodiments of the invention, an electrolyte switching system 1400 is provided to allow for continuous operation without degradation of performance while recirculating electrolyte as shown in FIG. 14. In specific embodiments of the invention, electrolyte must be continuously provisioned to the electrolyzer, but the electrolyte can become unsuitable for efficient operation over time due to several events, such as but not limited to consumption of hydroxide by the electrolytic process, carbonation and decline of the electrolyte pH, and accumulation of contaminants and electrolysis products. To enable continuous provision of electrolyte suitable for efficient operation, the electrolyte can be provisioned during electrolysis into the inlet of the electrolyzer from an electrolyte reservoir using a pump 1405. The electrolyte tank 1406 is connected to the inlet of the electrolyzer using a valve 1416 and three-way valve 1414 that leads to at least one other electrolyte tank 1407. A CO supply is passed from a CO supply 1401 through a fluid controller 1402 to a cathode of the electrolyzer 1403. A heating system 1404 and a series of safety valves can be included inline of the fluid connections. The electrolyte exits the outlet port of the electrolyzer 1403 and into second three-way valve 1413 fluidly connected to at least two electrolyte tanks 1406 and 1407. When the first electrolyte tank 1406 is depleted, the two three-way valves 1413 and 1414 can be switched to fluidly connect the second electrolyte tank 1407 to the inlet and outlet of the electrolyzer. The electrolyte in the first tank 1406 can then be regenerated or replaced through several means. When the second electrolyte tank 1407 is depleted, the two three-way valves 1413 and 1414 can be switched to fluidly connect the regenerated first electrolyte tank 1406 to the electrolyzer. The electrolyte in the second tank 1407 can then be regenerated, and the cycle can be continuously repeated to enable continuous provision of fresh electrolyte. If the anolyte compartment of the electrolyzer is operated at pressure, the two electrolyte tanks 1406 and 1407 can be fluidly and commonly connected to a pressure maintenance system. The pressure maintenance system can include one or more valves 1408 and 1410 and pressure regulators 1409 to isolate the electrolyte reservoirs to maintain consistent pressure at the electrolyzer, such as during an electrolyte regeneration cycle. A pressurized gas line 1412 is connected through valves 1411 and 1417 to flow the gas to electrolyte tank 1407.

Figure 15:
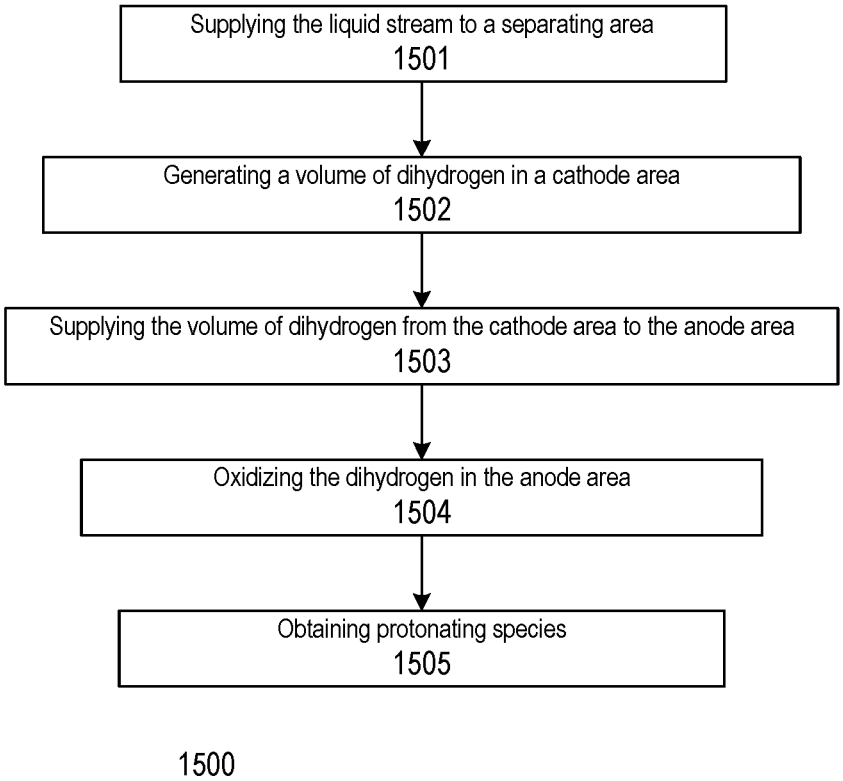
FIG. 15 illustrates a process for obtaining protonating species to be used in a separation process in accordance with specific embodiments of the inventions disclosed herein.

FIG. 15 discloses a process for separation 1500 comprising supplying the liquid stream to a separation area 1501. Further, generating a volume of dihydrogen in a cathode area 1502. Supplying the volume of dihydrogen from the cathode area to an anode area 1503. The dihydrogen is then oxidized in the anode area 1504 to obtain protonating species 1505.

Figure 16:
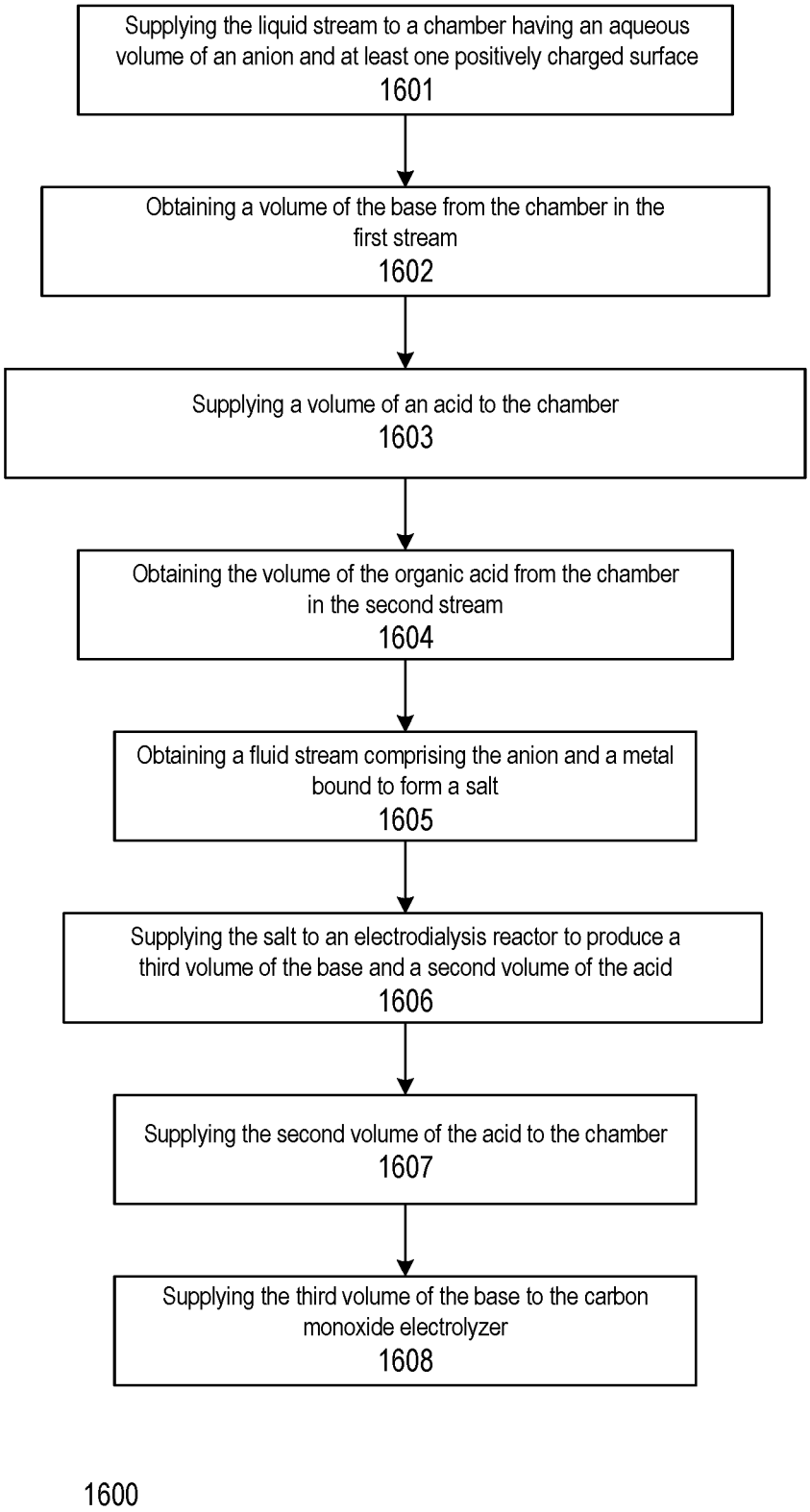
FIG. 16 illustrates a flow chart for a set of method steps for the separation process with an electrodialysis separator using cation exchange membranes in accordance with specific embodiments of the inventions disclosed herein.

FIG. 16 discloses a process of separation 1600 comprising supplying the liquid stream to a chamber having an aqueous volume of an anion and at least one positively charged surface 1601; obtaining the second volume of the base from the chamber in the first stream 1602; supplying a volume of an acid to the chamber 1603; obtaining the volume of the organic acid from the chamber in the second stream 1604; obtaining a fluid stream comprising the anion and a metal bound to form a salt 1605, supplying the salt to an electrodialysis reactor to produce a third volume of the base and a second volume of the acid 1606, supplying the second volume of the acid to the chamber 1607, and supplying the third volume of the base to the carbon monoxide electrolyzer 1608.

In specific embodiments of the inventions disclosed herein, a method 100 comprises supplying a volume of oxocarbon to a cathode area of an oxocarbon electrolyzer to be used as a reduction substrate 101. The reduction substrate is then used in generating a volume of an organic anion 102. The method also comprises obtaining a liquid stream comprising the volume of the organic anion and a volume of a base from the oxocarbon electrolyzer 103. The method also comprises generating, using a separation process 104 and from the liquid stream, a first stream 1 and a second stream 2. The first stream and the second stream are separated by the separation process. The separation process separates a volume of a cation from the liquid stream. The first stream includes a second volume of the base, and the second stream includes a volume of an organic acid. The volume of the organic acid includes the volume of the organic anion; and the second volume of the base includes the volume of the cation. However, the separation process 104 does not acidify the base. In specific embodiments, the separation process 104 includes an electrodialysis process. The method further comprises recirculating the first stream to the oxocarbon electrolyzer to maintain a pH of an electrolyte of the oxocarbon electrolyzer 105.

An example of separation process 104 is illustrated in FIG. 3 as block diagram 310 and comprises supplying the liquid stream to a separating area of an electrodialysis electrolyzer 301. The process also includes protonating, in the separating area and using a volume of a protonating species, the volume of the organic anion to generate the volume of the organic acid 302. Further, the process includes generating a volume of hydroxide anions in a cathode area of the electrodialysis electrolyzer 303. The volume of hydroxide anions and the volume of cations combine in the cathode area of the electrodialysis electrolyzer to generate the second volume of the base in the cathode area of the electrodialysis electrolyzer 304. The method further comprises obtaining the first stream from the cathode area of the electrodialysis electrolyzer 305 and obtaining the second stream from the separating area of the electrodialysis electrolyzer 306.

FIG. 3 also illustrates an anode area 300*c* of an electrodialysis electrolyzer 300 as isolated from the separating area 300*b* of the electrodialysis electrolyzer 300 by a first cation exchange membrane 300*y*. The separating area 300*b* of the electrodialysis electrolyzer 300 is located between the anode area 300*c* of the electrodialysis electrolyzer 300 and the cathode area 300*a* of the electrodialysis electrolyzer 300. The cathode area 300*a* of the electrodialysis electrolyzer 300 is isolated from the separating area 300*b* of the electrodialysis electrolyzer 300 by a cation exchange membrane 300*x*.

In specific embodiments of the invention, a separation process such as separation process 1500 comprises generating a volume of dihydrogen in the cathode area of the electrodialysis electrolyzer 1502 and supplying the volume of dihydrogen from the cathode area of the electrodialysis electrolyzer to an anode area of the electrodialysis electrolyzer 1503. The volume of dihydrogen is oxidized in the anode area 1504 of the electrodialysis electrolyzer to form the volume of the protonating species 1505.

Another example of separation process 104 is illustrated in FIG. 5 in block diagram 510. The process comprises supplying the liquid stream to a separating area of an electrodialysis electrolyzer 501, protonating, in an anode area of the electrodialysis electrolyzer and using a volume of a protonating species, the volume of the organic anion to generate the volume of the organic acid 502 and generating a volume of hydroxide anions in a cathode area of the electrodialysis electrolyzer 503. The volume of hydroxide anions and the volume of cations combine to generate the second volume of the base in the cathode area of electrodialysis electrolyzer 504. The process also comprises obtaining the first stream from the separating area of the electrodialysis electrolyzer 505 and obtaining the second stream from the anode area of the electrodialysis electrolyzer 506.

FIG. 5 also illustrates anode area 500*c* of the electrodialysis electrolyzer 500 as isolated from the separating area 500*b* of the electrodialysis electrolyzer 500 by an anion exchange membrane 500*y*. The separating area 500*b* of the electrodialysis electrolyzer 500 is located between the anode area 500*c* of the electrodialysis electrolyzer 500 and the cathode area 500*a* of the electrodialysis electrolyzer 500. The cathode area 500*a* of the electrodialysis electrolyzer 500 is isolated from the separating area 500*b* of the electrodialysis electrolyzer 500 by a second anion exchange membrane 500*x*.

Separation process 1500 further comprises generating a volume of dihydrogen in the cathode area of the electrodialysis electrolyzer 1502 and supplying the volume of dihydrogen from the cathode area of the electrodialysis electrolyzer to the anode area of the electrodialysis electrolyzer 1503. In this step, the volume of dihydrogen is oxidized in the anode area of the electrodialysis electrolyzer 1504 to form the volume of the protonating species 1505.

In specific embodiments of the invention, separation process 1600 further comprises supplying the liquid stream to a chamber having an aqueous volume of an anion and at least one positively charged surface 1601. Steps of an implementation in accordance with process 1600 are illustrated in FIG. 8. In the process, organic anion 804 binds to at least one positively charged surface 805. The process also includes obtaining a volume of the base from the chamber in a first stream 1602 that is withdrawn from the chamber and supplying a volume of an acid to the chamber 1603. The acid includes the organic anion 804, and the volume of the organic anion 804 is converted to a volume of the organic acid. The process also includes obtaining a volume of the organic acid from the chamber in a second stream 1604 that is withdrawn from the chamber.

The at least one positively charged surface 805 can be formed by an ionically charged adsorbent material; and the acid can be selected from a group consisting of HCl, HNO3, H2SO4, HClO4, and HBr.

The method further comprises obtaining a fluid stream comprising the anion and a metal bound to form a salt 1605, supplying the salt to an electrodialysis reactor to produce a volume of the base and a volume of the acid 1606, supplying the second volume of the acid to the chamber 1607, and supplying the third volume of the base to the carbon monoxide electrolyzer 1608. In the illustrated process, the organic anion 804 can be acetate, the organic acid can be acetic acid, the base can be one of potassium hydroxide and sodium hydroxide, the cation can be one of potassium and sodium, the reduction substrate is carbon monoxide.

In specific embodiments, the liquid stream is obtained from an anode area of the oxocarbon electrolyzer and the cathode area of the oxocarbon electrolyzer 103. The separation process of the present invention 104 can be conducted by a single separator. In specific embodiments, the methods can further comprise recirculating a first stream from the separator to the oxocarbon electrolyzer to maintain a pH of an electrolyte of the oxocarbon electrolyzer 105. The cathode area 201 can be a gaseous phase area. The liquid stream can be obtained from the anode area using a gas-liquid separator 206.

In specific embodiments, the separation process can use a membrane for a nanofiltration process. The separation process can monitor the liquid stream on one side of the membrane for a concentration and divert the liquid stream away from the membrane when the concentration passes a threshold.

In specific embodiments, a reduction substrate of the electrodialysis electrolyzer is one of dioxygen, nitrate, chlorine, bromine, a metal ion, a metal oxide, and a metal complex.

In specific embodiments, the separation process further comprises generating a volume of dihydrogen in a cathode area of the oxocarbon electrolyzer 1502 and supplying the volume of dihydrogen to an anode area of the electrodialysis electrolyzer 1503. In the process, the first stream and the second stream are generated by the electrodialysis electrolyzer using the volume of dihydrogen as an oxidation substrate.

In specific embodiments, the methods disclosed further comprise recirculating the first stream to the oxocarbon electrolyzer to maintain a pH of an electrolyte of the oxocarbon electrolyzer 105, and recirculating, while generating the first stream and the second stream, a third stream to the oxocarbon electrolyzer to maintain the pH of the electrolyte, where the third stream was generated in a prior iteration of the separation process.

In specific embodiments of the invention, a method 610 comprises supplying a volume of oxocarbon carbon to a cathode area of an oxocarbon electrolyzer to be used as a reduction substrate 605. The method also comprises generating a volume of an organic anion using a reduction substrate 606. The method also comprises obtaining a first liquid stream from an anode area of the oxocarbon electrolyzer and a second liquid stream from a cathode area of the oxocarbon electrolyzer 607. The first liquid stream and the second liquid stream include the volume of the organic anion and a volume of a base. The method also comprises generating, using a separation process 612 and from the first liquid stream and the second liquid stream, a basic stream wherein the basic stream includes a second volume of the base. The method also comprises recirculating the basic stream to the anode area of the oxocarbon electrolyzer to maintain a pH of an electrolyte of the oxocarbon electrolyzer 613.

In specific embodiments of the invention, the separation process 612 is conducted by a single separator that receives the first liquid stream and the second liquid stream from the cathode area and the anode area. In alternative embodiments, separate separators are used for those to streams. In specific embodiments, the cathode area **604*b*** is a gaseous phase area, and the second liquid stream is obtained from a trap on the cathode output. In specific embodiments, the first liquid stream is obtained from the anode area of the oxocarbon electrolyzer using a gas-liquid separator.

In specific embodiment of the invention, the separation process comprises the separation process 510 which is conducted by a first separator and a second separator, the first separator obtains the first liquid stream 1, the second separator obtains the second liquid stream 2, and the first separator and the second separator produce the basic stream in combination.

In another embodiment of the invention, a method comprises supplying a volume of oxocarbon to a cathode area of an oxocarbon electrolyzer to be used as a reduction substrate; generating a volume of an organic anion using the reduction substrate; obtaining a liquid stream from the oxocarbon electrolyzer. The liquid stream includes the volume of the organic anion and a volume of a base. The method also comprises generating, using a separation process and from the liquid stream, a first stream and a second stream. The first stream and the second stream are separate. The separation process separates a volume of a cation from the liquid stream. The first stream includes a second volume of the base. The separation process uses Kolbe electrolysis to oxidatively decarboxylate the organic anion. The second volume of the base includes the volume of the cation.

While the specification has been described in detail with respect to specific embodiments of the invention, it will be appreciated that those skilled in the art, upon attaining an understanding of the foregoing, may readily conceive of alterations to, variations of, and equivalents to these embodiments. The disclosure of volumes of chemicals in this disclosure is not meant to refer to a physically isolated volume as it is possible for a volume of dihydrogen to exist with a volume of carbon dioxide in a single physical volume in the form of a volume of syngas. Although examples in the disclosure were generally applied to industrial chemical processes, the same approaches are applicable to chemical processing of any scale and scope. Furthermore, although the separator technologies disclosed herein were generally applied to separating liquid products for oxocarbon electrolyzers, the separator technologies disclosed herein are more broadly applicable to separating liquid products generally. In specific embodiments of the invention, the separators disclosed herein may be used as shown in FIG. 2 but for a $CO_2$ electrolyzer reactor in place of the CO electrolyzer. Furthermore, although examples in this disclosure were directed to the separation of an organic anion from a liquid product stream, approaches herein are broadly applicable to the separation of an anion from a liquid product stream. These and other modifications and variations to the present invention may be practiced by those skilled in the art, without departing from the scope of the present invention, which is more particularly set forth in the appended claims.

What is claimed is:

1. A method comprising:

supplying a volume of oxocarbon to a cathode area of an oxocarbon electrolyzer to be used as a reduction substrate;

generating, via an electrochemical conversion, a volume of an organic anion using the reduction substrate;

obtaining a liquid stream from the oxocarbon electrolyzer, wherein the liquid stream includes the volume of the organic anion and a volume of a base; and generating, using a separation process and from the liquid stream, a first stream and a second stream, whereby the first stream and the second stream are separate, wherein the separation process includes an electrodialysis process and the electrodialysis process comprises: (i) generating a volume of dihydrogen in the cathode area of the oxocarbon electrolyzer; (ii) supplying the volume of dihydrogen to an anode area of an electrodialysis electrolyzer; (iii) supplying the liquid stream to the electrodialysis electrolyzer; and (vi) obtaining the first stream and the second stream from the electrodialysis electrolyzer; whereby the first stream and the second stream are generated by the electrodialysis electrolyzer using the volume of dihydrogen as an oxidation substrate;

wherein: (i) the separation process separates a volume of a cation from the liquid stream; (ii) the first stream includes a second volume of the base; (ii) the second stream includes a volume of an organic acid; (iii) the volume of the organic acid includes the volume of the organic anion; (iv) the second volume of the base includes the volume of the cation; and (v) a reduction substrate of the electrodialysis electrolyzer is one of dioxygen, nitrate, chlorine, bromine, a metal ion, a metal oxide, and a metal complex.

2. The method of claim 1, wherein:

the separation process does not acidify the base.

3. The method of claim 1, wherein the separation process further comprises:

supplying the liquid stream to a separating area of the electrodialysis electrolyzer;

protonating, in the separating area and using a volume of a protonating species, the volume of the organic anion to generate the volume of the organic acid;

generating a volume of hydroxide anions in a cathode area of the electrodialysis electrolyzer, whereby the volume of hydroxide anions and the volume of the cation combine in the cathode area of the electrodialysis electrolyzer to generate the second volume of the base in the cathode area of the electrodialysis electrolyzer;

obtaining the first stream from the cathode area of the electrodialysis electrolyzer; and obtaining the second stream from the separating area of the electrodialysis electrolyzer.

4. The method of claim 3, wherein:

an anode area of the electrodialysis electrolyzer is isolated from the separating area of the electrodialysis electrolyzer by a first cation exchange membrane;

the separating area of the electrodialysis electrolyzer is located between the anode area of the electrodialysis electrolyzer and the cathode area of the electrodialysis electrolyzer; and the cathode area of the electrodialysis electrolyzer is isolated from the separating area of the electrodialysis electrolyzer by a second cation exchange membrane.

5. The method of claim 3, wherein the separation process further comprises:

generating a volume of dihydrogen in the cathode area of the electrodialysis electrolyzer; and supplying the volume of dihydrogen from the cathode area of the electrodialysis electrolyzer to an anode area of the electrodialysis electrolyzer;

whereby the volume of dihydrogen is oxidized in the anode area of the electrodialysis electrolyzer to form the volume of the protonating species.

6. The method of claim 1, wherein the separation process further comprises:

supplying the liquid stream to a separating area of the electrodialysis electrolyzer;

protonating, in an anode area of the electrodialysis electrolyzer and using a volume of a protonating species, the volume of the organic anion to generate the volume of the organic acid;

generating a volume of hydroxide anions in a cathode area of the electrodialysis electrolyzer, whereby the volume of hydroxide anions and the volume of the cation combine to generate the second volume of the base in the cathode area of the electrodialysis electrolyzer;

obtaining the first stream from the separating area of the electrodialysis electrolyzer; and obtaining the second stream from the anode area of the electrodialysis electrolyzer.

7. The method of claim 6, wherein:

the anode area of the electrodialysis electrolyzer is isolated from the separating area of the electrodialysis electrolyzer by a first anion exchange membrane;

the separating area of the electrodialysis electrolyzer is located between the anode area of the electrodialysis electrolyzer and the cathode area of the electrodialysis electrolyzer; and the cathode area of the electrodialysis electrolyzer is isolated from the separating area of the electrodialysis electrolyzer by a second anion exchange membrane.

8. The method of claim 6, wherein the separation process further comprises:

generating a volume of dihydrogen in the cathode area of the electrodialysis electrolyzer; and supplying the volume of dihydrogen from the cathode area of the electrodialysis electrolyzer to the anode area of the electrodialysis electrolyzer;

whereby the volume of dihydrogen is oxidized in the anode area of the electrodialysis electrolyzer to form the volume of the protonating species.

9. The method of claim 1, wherein:

the organic anion is acetate;

the organic acid is acetic acid;

the base is one of potassium hydroxide and sodium hydroxide;

the cation is one of potassium and sodium; and the reduction substrate is carbon monoxide.

10. The method of claim 1, further comprising:

pyrolyzing the second stream to form acetone.

11. The method of claim 1, wherein:

the liquid stream is obtained from an anode area of the oxocarbon electrolyzer and the cathode area of the oxocarbon electrolyzer;

the separation process is conducted by a single separator; and the method further comprises recirculating the first stream to the oxocarbon electrolyzer to maintain a pH of an electrolyte of the oxocarbon electrolyzer.

12. The method of claim 11, wherein:

the cathode area is a gaseous phase area; and the liquid stream is obtained from the anode area using a gas-liquid separator.

13. The method of claim 1, wherein:

the separation process uses a membrane for nanofiltration process; and the separation process monitors the liquid stream on one side of the membrane for a concentration and diverts the liquid stream away from the membrane when the concentration passes a threshold.

14. The method of claim 1, further comprising:

generating a useful species using the oxocarbon electrolyzer;

wherein: (i) the useful species is the organic acid; and (ii) the second stream is a purified stream of the organic acid.

15. The method of claim 1, further comprising:

recirculating the first stream to the oxocarbon electrolyzer to maintain a pH of an electrolyte of the oxocarbon electrolyzer; and recirculating, while generating the first stream and the second stream, a third stream to the oxocarbon electrolyzer to maintain the pH of the electrolyte, wherein the third stream was generated in a prior iteration of the separation process.

16. A method comprising:

supplying a volume of oxocarbon to a cathode area of an oxocarbon electrolyzer to be used as a reduction substrate;

generating, via an electrochemical conversion, a volume of an organic anion using the reduction substrate;

obtaining a liquid stream from the oxocarbon electrolyzer, wherein the liquid stream includes the volume of the organic anion and a volume of a base; and generating, using a separation process and from the liquid stream, a first stream and a second stream, whereby the first stream and the second stream are separate;

wherein: (i) the separation process separates a volume of a cation from the liquid stream; (ii) the first stream includes a second volume of the base; (ii) the second stream includes a volume of an organic acid; (iii) the volume of the organic acid includes the volume of the organic anion; (iv) the second volume of the base includes the volume of the cation; (v) the separation process uses a membrane for nanofiltration process; and (vi) the separation process monitors the liquid stream on one side of the membrane for a concentration and diverts the liquid stream away from the membrane when the concentration passes a threshold.

17. A method comprising:

supplying a volume of oxocarbon to a cathode area of an oxocarbon electrolyzer to be used as a reduction substrate;

generating, via an electrochemical conversion, a volume of an organic anion using the reduction substrate;

obtaining a liquid stream from the oxocarbon electrolyzer, wherein the liquid stream includes the volume of the organic anion and a volume of a base;

generating, using a separation process and from the liquid stream, a first stream and a second stream, whereby the first stream and the second stream are separate;

recirculating the first stream to the oxocarbon electrolyzer to maintain a pH of an electrolyte of the oxocarbon electrolyzer; and recirculating, while generating the first stream and the second stream, a third stream to the oxocarbon electrolyzer to maintain the pH of the electrolyte, wherein the third stream was generated in a prior iteration of the separation process;

wherein: (i) the separation process separates a volume of a cation from the liquid stream; (ii) the first stream includes a second volume of the base; (ii) the second stream includes a volume of an organic acid: (iii) the volume of the organic acid includes the volume of the organic anion; and (iv) the second volume of the base includes the volume of the cation.

* * * * *